US007173599B2

(12) United States Patent
Nishimura

(10) Patent No.: US 7,173,599 B2
(45) Date of Patent: Feb. 6, 2007

(54) IMAGE DISPLAY METHOD IN TRANSMISSIVE-TYPE LIQUID CRYSTAL DISPLAY DEVICE AND TRANSMISSIVE-TYPE LIQUID CRYSTAL DISPLAY DEVICE

(75) Inventor: Mitsuhisa Nishimura, Tokyo (JP)

(73) Assignee: NEC LCD Technologies Ltd., Kanagawa (JP)

( * ) Notice: Subject to any disclaimer, the term of this patent is extended or adjusted under 35 U.S.C. 154(b) by 528 days.

(21) Appl. No.: 10/127,419

(22) Filed: Apr. 23, 2002

(65) Prior Publication Data

US 2002/0154088 A1 Oct. 24, 2002

(30) Foreign Application Priority Data

Apr. 24, 2001 (JP) ..... 2001-126686

(51) Int. Cl.
*G09G 3/36* (2006.01)

(52) U.S. Cl. ..... 345/102; 345/89; 345/87; 345/95; 345/93

(58) Field of Classification Search ..... 345/87, 345/94, 96, 99, 102, 92, 506, 100, 97, 63, 345/88, 520, 628, 4, 132, 89, 93, 95, 31, 345/419, 589; 349/25; 455/566
See application file for complete search history.

(56) References Cited

U.S. PATENT DOCUMENTS 4,958,915 A * 9/1990 Okada et al. ..... 345/102
5,638,084 A * 6/1997 Kalt ..... 345/31
5,844,540 A * 12/1998 Terasaki ..... 345/102
5,905,527 A 5/1999 Inou et al.
5,940,539 A 8/1999 Kondo et al.
5,943,034 A * 8/1999 Adachi ..... 345/94
6,020,879 A * 2/2000 Nakabayashi ..... 345/102
6,023,277 A * 2/2000 Osaka et al. ..... 345/419
6,073,034 A * 6/2000 Jacobsen et al. ..... 455/566
6,157,396 A * 12/2000 Margulis et al. ..... 345/506
6,329,971 B2 * 12/2001 McKnight ..... 345/95
6,380,917 B2 * 4/2002 Matsueda et al. ..... 345/89
6,380,932 B1 * 4/2002 Kawasaki et al. ..... 345/102
6,396,469 B1 * 5/2002 Miwa et al. ..... 345/87
6,404,145 B1 * 6/2002 Saito ..... 345/102
6,429,839 B1 * 8/2002 Sakamoto ..... 345/87

(Continued)

FOREIGN PATENT DOCUMENTS

EP 0 666 009 5/1999

(Continued)

*Primary Examiner*—Bipin Shalwala
*Assistant Examiner*—Prabodh Dharia
(74) *Attorney, Agent, or Firm*—Young & Thompson

(57) ABSTRACT

A method is provided for displaying an image in a liquid crystal display which enables a scale of a power supply circuit for supplying power to a backlight to be small-sized and the power supply circuit to be low-priced and power consumption of the backlight to be reduced and which enables a flickering phenomenon, a trail-leaving phenomenon (trail-effect), and an image-retention phenomenon to be decreased. In the method for displaying the image in the liquid crystal display device, based on a motion vector, by doing switching between an image signal making up the above image and a blanking signal and by applying a plurality of data electrodes making up the liquid crystal display device, an image signal or a non-image signal is displayed.

4 Claims, 25 Drawing Sheets

U.S. PATENT DOCUMENTS

| | | | | |
|---|---|---|---|---|
| 6,452,582 | B1 * | 9/2002 | Rolston | 345/102 |
| 6,504,523 | B1 * | 1/2003 | Sugawara et al. | 345/98 |
| 6,507,330 | B1 * | 1/2003 | Handschy et al. | 345/94 |
| 6,552,711 | B1 * | 4/2003 | Nakamura | 345/102 |
| 6,570,554 | B1 * | 5/2003 | Makino et al. | 345/102 |
| 6,597,339 | B1 * | 7/2003 | Ogawa | 345/102 |
| 6,670,943 | B1 * | 12/2003 | Ishii et al. | 345/100 |
| 6,750,837 | B1 * | 6/2004 | Kondoh | 345/97 |
| 7,027,058 | B2 * | 4/2006 | Tomooka et al. | 345/538 |
| 2001/0002124 | A1 * | 5/2001 | Mamiya et al. | 345/132 |
| 2001/0006375 | A1 * | 7/2001 | Tomooka et al. | 345/4 |
| 2001/0038387 | A1 * | 11/2001 | Tomooka et al. | 345/520 |
| 2002/0060657 | A1 * | 5/2002 | Matsueda et al. | 345/89 |
| 2002/0101433 | A1 * | 8/2002 | McKnight | 345/589 |
| 2002/0154088 | A1 * | 10/2002 | Nishimura | 345/102 |
| 2002/0158823 | A1 * | 10/2002 | Zavracky et al. | 345/87 |

FOREIGN PATENT DOCUMENTS

| | | | |
|---|---|---|---|
| EP | 1061499 | A2 * | 12/2000 |
| EP | 1 120 679 | A1 | 8/2001 |
| EP | 1120679 | A1 * | 8/2001 |
| JP | 64-82019 | | 3/1989 |
| JP | A 64-82019 | | 3/1989 |
| JP | 09-93585 | | 4/1997 |
| JP | A 9-93585 | | 4/1997 |
| JP | 9-212650 | | 8/1997 |
| JP | A 9-212650 | | 8/1997 |
| JP | 11-109921 | | 4/1999 |
| JP | A 11-109921 | | 4/1999 |
| WO | 01/13167 | A1 | 2/2001 |

* cited by examiner

| BC | blanking ratio (%) |
|---|---|
| 0 | 0.0 |
| 10 | 25.0 |
| 15 | 37.5 |
| 20 | 50.0 |
| 25 | 62.5 |
| 30 | 75.0 |

FIG.20

| BC | blanking ratio(%) | lighting rate | | | |
|---|---|---|---|---|---|
| | | measure A | | measure B | |
| | | peak(%) | average(%) | peak(%) | average(%) |
| 0 | 0.0 | 100 | 100 | 100 | 100 |
| 10 | 25.0 | 100 | 100 | 100 | 100 |
| 15 | 37.5 | 100 | 87.5 | 87.5 | 87.5 |
| 20 | 50.0 | 100 | 75.0 | 75.0 | 75.0 |
| 25 | 62.5 | 100 | 62.5 | 62.5 | 62.5 |
| 30 | 75.0 | 100 | 50.0 | 50.0 | 50.0 |

FIG.21

| BC | blanking ratio(%) | power consumption | | | | | |
|---|---|---|---|---|---|---|---|
| | | second conventional example (%) | measure A | | measure B | | |
| | | | peak(%) | average(%) | peak(%) | average(%) | |
| 0 | 0.0 | 100 | 100 | 100 | 100 | 100 | (%) |
| 10 | 25.0 | 133(75) | 133 | 133 | 133 | 133 | |
| 15 | 37.5 | 160(63) | 160 | 140 | 140 | 140 | (71) |
| 20 | 50.0 | 200(50) | 200 | 150 | 150 | 150 | (67) |
| 25 | 62.5 | 267(37) | 267 | 167 | 167 | 167 | (60) |
| 30 | 75.0 | 400(25) | 400 | 200 | 200 | 200 | (50) |

FIG.22

| BC | blanking ratio(%) | second conventional example /measure A (peak) | | second conventional example /measure B (peak) | |
|---|---|---|---|---|---|
| | | power consumption(%) | display luminance(%) | power consumption(%) | display luminance(%) |
| 0 | 0.0 | 100 | 100 | 100 | 100 |
| 10 | 25.0 | 133 | 100 | 133 | 100 |
| 15 | 37.5 | 133 | 84 | 133 | 94 |
| 20 | 50.0 | 133 | 67 | 133 | 89 |
| 25 | 62.5 | 133 | 49 | 133 | 80 |
| 30 | 75.0 | 133 | 33 | 133 | 67 |

FIG.28
| window number | window size H and V(pixel) | window position X, Y | kind of display content T | priority P | moving picture parameter |
|---|---|---|---|---|---|
| 30 | 1920, 1080 | | | | |
| 31 | 1400, 850 | 400, 200 | 2 | 2 | 75 |
| 32 | 1280, 720 | 150, 100 | 1 | 1 | 0 |
| . | . | . | . | . | . |
| . | . | . | . | . | . |
| . | . | . | . | . | . |
FIG.29A
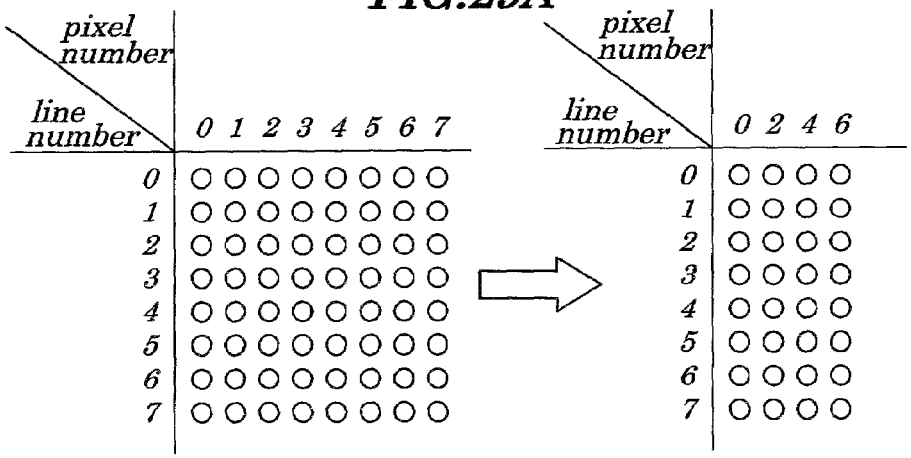
FIG.29B
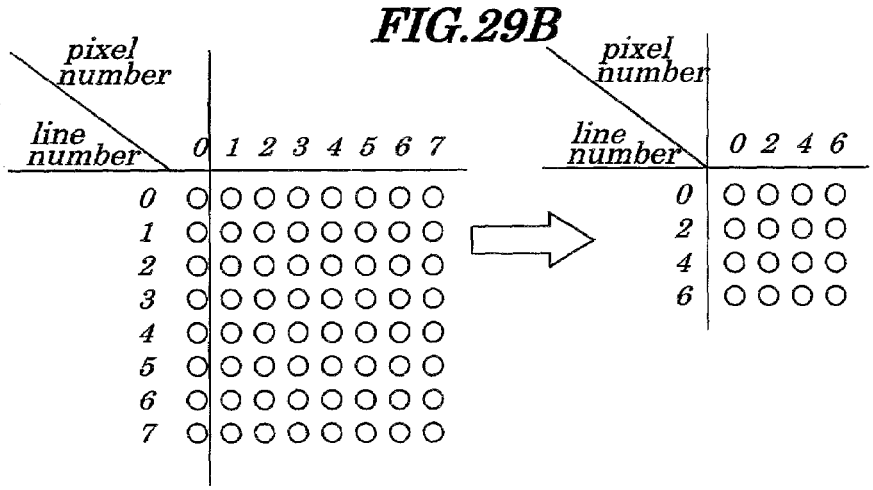

*FIG.35*

| *diplay moving picture parameter* | *0* | *5* | *10* | *15* | *20* | *25* | *30* | *35* | *40* | *45* | *50* | *55* | *60* | *65* | *70* | *75* |
|---|---|---|---|---|---|---|---|---|---|---|---|---|---|---|---|---|
| *blanking ratio* | *0* | *0* | *0* | *0* | *0* | *25* | *25* | *25* | *25* | *25* | *50* | *50* | *50* | *50* | *50* | *55* |
| *relative luminance obtained before multiplication* | *100* | *100* | *100* | *100* | *100* | *75* | *75* | *75* | *75* | *75* | *50* | *50* | *50* | *50* | *50* | *25* |
| *multiplication coefficient* | *1.00* | *0.95* | *0.90* | *0.85* | *0.80* | *1.00* | *0.93* | *0.87* | *0.80* | *0.73* | *1.00* | *0.90* | *0.80* | *0.70* | *0.60* | *1.00* |
| *relative luminance obtained after multiplication* | *100* | *95* | *90* | *85* | *80* | *75* | *70* | *65* | *60* | *55* | *50* | *45* | *40* | *35* | *30* | *25* |

IMAGE DISPLAY METHOD IN TRANSMISSIVE-TYPE LIQUID CRYSTAL DISPLAY DEVICE AND TRANSMISSIVE-TYPE LIQUID CRYSTAL DISPLAY DEVICE

BACKGROUND OF THE INVENTION

1. Field of the Invention

The present invention relates to an image display method in a transmissive-type liquid crystal display device and to the transmissive-type liquid crystal display device and more particularly to the image display method in the transmissive-type liquid crystal display device to display an image made up of a moving picture and a still picture on a transmissive-type liquid crystal display (LCD) and to the transmissive-type liquid crystal display device employing the above image display method.

The present application claims priority of Japanese Patent Application No. 2001-126686 filed on Apr. 24, 2001, which is hereby incorporated by reference.

2. Description of the Related Art

One example of an image made up of a moving picture and a still picture is a television picture. There are various types of methods of transmitting a television image and in the case of, for example, NTSC (National Television System Committee) method, a period (frame period) during which a television picture is displayed on a display screen, for example, a CRT (Cathode Ray Tube) is 16.7 ms. In an LCD, time (response time) required for switching between one screen and another screen is 20 ms to 30 ms, due to its characteristics, which is longer than the frame period of 16.7 ms described above. The response time becomes longest when a display is switched from a black to a white or from a white to a black on an LCD. Therefore, a display characteristic obtained when a television picture is displayed on the LCD is inferior to that obtained when the television picture is displayed on the CRT display screen. To solve this problem, when the image made up of the moving picture and the still picture such as the television picture or a like is displayed on the LCD, various technologies are conventionally proposed with an aim of achieving the display characteristic being equal to the display characteristic that the CRT display can provide. For example, Japanese Patent Application Laid-open No. Sho 64-82019 discloses a liquid crystal display device that can display a sharp picture having a high contrast ratio. The disclosed liquid crystal display device includes an illuminating section having a plurality of light-emitting portions each being able to selectively flash as a backlight of the LCD and an illuminating and scanning section. adapted to sequentially scan and flash each of the light-emitting portions with timing when a scanning electrode making up the LCD is driven. The illuminating and scanning section controls so as to turn on each of the light-emitting portions immediately after all scanning electrodes existing in a corresponding range where illuminating is needed have been selected and to turn off the light-emitting portions after a specified period of time. Hereinafter, the technology employed in this disclosed liquid crystal display device is called a "first conventional example".

Moreover, Japanese Patent Application Laid-open No. Hei 11-109921 discloses a liquid crystal display device which displays a moving picture having less blur and having high quality and having no ghosting on an LCD. In the disclosed liquid crystal display device, a scanning electrode making up the LCD is selected to display an image on the LCD during one period out of frame periods during which an image is displayed and, at the same time, an image signal to display the above image is fed to a data electrode making up the LCD. Next, in the liquid crystal display device, the above scanning electrode is selected again during a period being different from the above one period out of the same frame periods that contains the above one period and a non-image signal (a so-called "blanking signal") having a specified potential and being different from the above image signal is fed to the above data electrode. Hereinafter, the technology employed in this disclosed liquid crystal display device is called a "second conventional example".

In the liquid crystal display device of the above first and second conventional examples, irrespective of whether an image to be displayed on the LCD is a moving picture or a still picture, the LCD and illuminating section are controlled by a same way which provides ease of control. Therefore, in the first conventional example, there is conventionally a shortcoming that a display screen flickers. Moreover, in the first conventional example, if the backlight is turned on, for example, only for a period being one-fourth of one frame period, in order to maintain same display luminance as is in a case where the backlight is turned on all the time, fourfold display luminance is required when being estimated by using a simplified calculation. This presents a problem in that power consumption by the backlight is large. This, therefore, causes a scale of a power supply circuit for supplying power to the backlight to become large and the power supply circuit to be high-priced.

On the other hand, in the second conventional example, there are shortcomings in that, when a moving picture is displayed in the LCD, a phenomenon called a "trail-leaving phenomenon (trail-effect)" occurs in which a trail-like unwanted image is left after a moving object in an image on a screen and/or a phenomenon called an "image-retention phenomenon" occurs in which an image that was previously displayed is still left on a screen. Moreover, in the second conventional example, if an image signal is supplied for a period being one-fourth of one frame period to a data electrode of the LCD, to maintain same display luminance as is in a case where an image signal is fed for all the periods of one frame period, fourfold display luminance is required when being estimated by using a simplified calculation. This causes power consumption by the backlight to become large.

SUMMARY OF THE INVENTION

In view of the above, it is an object of the present invention to provide an image display method in a transmissive-type liquid crystal display device and the transmissive-type liquid crystal display device which, when an image made up of a moving picture and a still picture is displayed on a transmissive-type liquid crystal display, enable a scale of a power supply circuit for supplying power to a backlight to be made small and the power supply circuit to be low-priced and power consumption of the backlight to be reduced, thus reducing a flickering phenomenon, a trail-leaving phenomenon, and an image-retention phenomenon. As a result, a display characteristic being equal to a display characteristic that a CRT provides can be obtained.

According to a first aspect of the present invention, there is provided a method for displaying an image in a transmissive-type liquid crystal display device including: an LCD and a backlight to emit light to the liquid crystal display from a rear of the liquid crystal display, the method including:

a step of displaying an image signal or a non-image signal being different from the image signal by doing switching between the image signal and the non-image signal, based on a result from detection of a motion of an image, and by applying said image signal or said non-image signal to a plurality of data electrodes making up the liquid crystal display.

With the above configuration, when an image made up of a moving picture and a still picture is displayed on the LCD, a power supply circuit to supply power to a backlight can be made small-sized and low-priced and power consumption of the backlight can be reduced. Moreover, it is possible to reduce a flickering phenomenon, a tail-leaving phenomenon, an image retention phenomenon occurring on a display screen and to obtain a display characteristic with a same level of a display characteristic as that of a CRT display.

In the foregoing, a preferable mode is one wherein one or a plurality of moving picture parameters is controlled based on the result from detection.

With the above configuration, when a motion of an image to be displayed is fast, control can be exerted so that a moving picture parameter responds to a fast motion and, when a motion of an image to be displayed is slow, though the moving picture parameter cannot respond to the slow motion, it is possible to control so as to obtain a beautiful image on a screen. For example, when a motion of an image is fast, while a rate at which a non-image signal is displayed during one frame period is increased and control is exerted so that a level of a non-image signal completely comes nearer to a level of a white color rather than a level of a black color. By controlling as above, though a decrease in display luminance can be prevented, a black color floats and contrast decreases. That is, when a motion of an image is fast, a fast motion is followed by sacrificing contrast. On the other hand, when a motion of an image is slow, a rate at which a non-image signal is displayed during one frame period while a level of a non-image signal is controlled so that a signal level becomes a level of a black color. By configuring as above, display luminance and contrast are increased. That is, when a motion of an image becomes low, though a fast motion cannot be followed, an image with high luminance and contrast can be realized. The moving picture parameter is not limited to parameters described in the embodiments of the present invention. The moving picture parameter includes, for example, a parameter for control on overshoot.

Also, a preferable mode is one wherein the non-image signal is a signal corresponding to a specified signal level of the image signal.

Also, a preferable mode is one wherein the non-image signal is a signal corresponding to a specified black signal level of the image signal.

Also, a preferable mode is one wherein the moving picture parameter includes at least one of a rate at which the non-image signal is displayed during one frame period, a signal level of the non-image signal, and illumination of the backlight.

Also, a preferable mode is one wherein the result from detection is a size of a motion vector detected from the image or contained in the image signal.

With the above configuration, control can be exerted so that a moving picture parameter can be changed based on a size of a motion vector, which can achieve an image with high quality.

Also, a preferable mode is one wherein the result from detection is a size of a fastest motion vector detected from a specified region of the image or contained in the image signal in a specified region of the image.

Also, a preferable mode is one wherein, in response to the result from detection of a motion of the image, when the image is changed from a still picture to a moving picture, control is exerted so that the moving picture parameter rapidly follows the result from detection and, when the image is changed from a moving picture to a still picture, control is exerted so that the moving picture parameter gently follows the result from detection.

With the above configuration, control can be exerted so that only a portion in which switching is done between a moving picture and a still picture, that is, only apart in which display luminance changes is changed with a specified gradient. This enables an observer to see without a feeling of disorder.

Also, a preferable mode is one wherein, when a size of the motion vector changes in an direction that the size increases, control is exerted so that a change in the moving picture parameter rapidly follows a size of the motion vector and, when a size of the motion vector changes in a direction that the size decreases, control is exerted so that a change in the moving picture parameter gently follows a size of the motion vector.

Also, a preferable mode is one wherein, when the result from detection changes to a direction in which control is required so that a rate at which the non-image signal is displayed during one frame period is increased, control is exerted so that a change in the moving picture parameter rapidly follows a size of the motion vector and, when the result from detection changes to a direction in which control is required so that a rate at which the non-image signal is displayed during one frame period is decreased, control is exerted so that a change in the moving picture parameter gently follows a size of the motion vector.

Also, a preferable mode is one wherein the image signal, after having undergone a gamma correction, is switched to the non-image signal and is applied to the plurality of the data electrodes making up the liquid crystal display and wherein the moving picture parameter includes information about the gamma correction.

With the above configuration, there are some cases in which illumination of a backlight changes, a spectrum of a light source changes. At this time, by controlling a characteristic of a gamma correction to an image signal, a color characteristic of an image to be displayed can be adjusted.

Also, a preferable mode is one wherein display timing with which the non-image signal is displayed on a plurality of main scanning display lines of the liquid crystal display is set in a manner that there is a period of time during which the display timing is overlapped while the non-image signal is displayed on the plurality of the main scanning display lines and wherein the backlight is turned OFF during a period while the display timing is overlapped or during a part of the period while the display timing is overlapped.

Also, a preferable mode is one wherein display timing with which the non-image signal is displayed on two or more main scanning display lines of the liquid crystal display is set to be different for every two or more main scanning display lines or for every two or more blocks and wherein a part of the backlight corresponding to the two or more main scanning display lines or to the two or more blocks is turned OFF.

A preferable mode is one wherein display timing of the non-image signal is controlled by timing with which the non-image signal is fed to the plurality of data electrodes.

A preferable mode is one wherein an image is made up of a plurality of windows and, based on a result from detection of a motion of the image, switching is done between the image signal and the non-image signal for every window and switched signals are fed to a plurality of data electrodes making up the liquid crystal display to display the image signal or the non-image signal.

With the above configuration, when a plurality of windows is displayed on a liquid crystal display, if a kind of a display content of an image signal to be displayed in each window is different, a moving parameter can be controlled in each window. Therefore, in this case, an image with high quality can be obtained.

A preferable mode is one wherein one or a plurality of moving picture parameters is controlled for every window, based on the result from detection of a motion of the image making up the window or based on the result from detection, a type of the image or a size of the window.

With the above configuration, a motion of an image to be displayed is a concept being independent from a size of a window to be displayed. However, an actual speed of an object depends on a size of a screen. For example, a reason why a speed of a following operation of a liquid crystal presents no problem in a 5-type liquid crystal display is that, since a display screen is so small and a speed is one-tenth of a 50-type liquid crystal display. Therefore, by controlling a moving picture parameter, based on a size of a window to be displayed, the speed of a following operation can be calibrated by using a speed of actual movement of an object on a display screen. Further, a speed of feeling by an observer's vision depends on an angle formed by two points between which an object has moved during a specified period of time, that is, on a size of a visual angle. Moreover, a visual angle depends not only on a speed of an actual speed of an object on a display screen but also a distance between a display screen and an observer. Therefore, in order to control a moving picture parameter by a speed of a motion felt by an observer, a control has to be exerted by a result of detection of a motion of an image making up a window, a size of a window, and a distance from a display screen to an observer. However, since a distance between a display screen to an observer does not change in terms of time, even if the distance is not positively included as a control parameter, it falls within an initial value. In some cases, a motion of an image to be displayed can be predicted by a type of an image to be displayed. For example, a motion in an image in a sports program is faster than that in an image in a general news program. Then, based on types of images, a moving picture parameter can be controlled.

A preferable mode is one wherein, based on the result from detection of a motion of the image making up the window, when the image is judged to be a moving picture, the image signal and the non-image signal are fed during one frame period to the plurality of data electrodes and, when the image is judged to be a still image, the image signal only is fed during the one frame period two or more times to the plurality of data electrodes.

A preferable mode is one wherein the moving picture parameter includes a rate at which the non-image signal is displayed during one frame period, a level of the non-image signal and illumination of the backlight.

A preferable mode is one wherein the image signal, after having undergone a gamma correction, is switched to the non-image signal and then is applied to the plurality of data electrodes making up the liquid crystal display and wherein the moving picture parameter includes information about the gamma correction.

A preferable mode is one wherein a specified multiplication coefficient corresponding to the moving picture parameter for the window is multiplied by the image signal making up the window and a result from the multiplication is applied to the plurality of data electrodes.

A preferable mode is one wherein, the multiplication coefficient is a coefficient which reduces a discontinuous change in display luminance caused by a discontinuous change of a rate at which the non-image signal making up the window is displayed during one frame period.

A preferable mode is one wherein the multiplication coefficient includes information about the gamma correction.

A preferable mode is one wherein levels of the non-image signals and rates at which the non-image signals are displayed during one frame period are same between a plurality of windows in which the image are judged to be moving pictures.

A preferable mode is one wherein the plurality of windows in which the image is judged to be a moving picture does not share same main scanning display lines in the liquid crystal display device.

According to a second aspect of the present invention, there is provided a transmissive-type liquid crystal display device having a liquid crystal display and a backlight to emit light to the liquid crystal display from a rear of the liquid crystal display, including:

a detection circuit to detect a motion of an image; and a control circuit to display an image signal or a non-image signal by doing switching between the image signal and the non-image signal being different from the image signal, based on a result from detection of a motion of an image and by applying a plurality of data electrodes making up the liquid crystal display.

With the above configuration, when an image is made up of a moving picture and a still image is displayed on a liquid crystal display, a power supply circuit to supply power to a backlight can be made small-sized and low-priced and also power consumption is reduced. Moreover, it is possible to reduce a flickering phenomenon, a tail-leaving phenomenon, an image retention phenomenon occurring on a display screen and to obtain a display characteristic with a same level of a display characteristic as that of the CRT display.

According to a third aspect of the present invention, there is provided a transmissive-type liquid crystal display device according to Claim 25, wherein the control circuit, based on the result from detection, controls one or a plurality of moving picture parameters.

With the above configuration, when a motion of an image to be displayed is fast, control can be exerted so that a moving parameter responds to a fast motion and, when a motion of an image to be displayed is slow, though the moving parameter cannot respond to the slow motion, control can be possible to make an image on a screen look beautiful. For example, when a motion of an image is fast, while a rate at which a non-image signal is displayed during one frame period is increased and control is exerted so that a level of a non-image signal completely comes nearer to a level of a white color rather than a level of a black color. By controlling as above, though a decrease in display luminance can be prevented, a black color floats and contrast decreases. That is, when a motion of an image is fast, a fast motion is followed by sacrificing contrast. On the other hand, when a motion of an image is slow, a rate at which a non-image signal is displayed during one frame period while a level of a non-image signal is controlled so that a signal level becomes a level of a black color. By configuring as above, display luminance and contrast are increased. That is, when a motion of an image becomes slow, though a fast motion cannot be followed, an image with high luminance and contrast can be realized. The moving picture parameter is not limited to parameters described in the embodiments of the present invention. The moving picture parameter includes, for example, a parameter for control on overshoot.

In the foregoing, a preferable mode is one wherein the non-image signal is a signal corresponding to a specified signal level of the image signal.

Also, a preferable mode is one wherein the non-image signal is a signal corresponding to a specified signal level of the image signal.

Also, a preferable mode is one wherein the moving picture parameter is made up of at least one of a rate at which the non-image signal is displayed during one frame period, a signal level of the non-image signal, and illumination of the backlight.

Also, a preferable mode is one wherein the result from detection is a size of a motion vector detected from the image or contained in the image signal.

Also, a preferable mode is one wherein the result from detection is a size of a fastest motion vector detected from a specified region of the image or contained in the image signal in a specified region of the image.

Also, a preferable mode is one wherein the control circuit, in response to a result from detection of a motion of the image, when the image is changed from a still picture to a moving picture, exerts control so that the moving picture parameter rapidly follows the result from detection and, when the image is changed from a moving picture to a still picture, exerts control so that the moving picture parameter gently follows the result from detection.

With the above configuration, control can be exerted so that a moving picture parameter can be changed based on a size of a motion vector, which can achieve an image with high quality.

Also, with the above configuration, control can be exerted so that only a portion in which switching is done between a moving picture and a still picture, that is, only a part in which display luminance changes is changed with a specified gradient. This enables an observer to see without a feeling of disorder.

Also, a preferable mode is one wherein the control circuit, when a size of the moving picture changes in an direction that the size increases, exerts control so that a change in the moving picture parameter rapidly follows a size of the motion vector and, when a size of the moving picture changes in a direction that the size decreases, exerts control so that a change in the moving picture parameter gently follows a size of the motion vector.

Also, a preferable mode is one wherein the control circuit, when the result from detection changes to a direction in which control is required so that a rate at which the non-image signal is displayed during one frame period is increased, exerts control so that a change in the moving picture parameter rapidly follows a size of the motion vector and, when the result from detection changes to a direction in which control is required so that a rate at which the non-image signal is displayed during one frame period is decreased, exerts control so that a change in the moving picture parameter gently follows a size of the motion vector.

Also, a preferable mode is one that wherein includes a gamma correcting circuit to make a gamma correction to the image signal, wherein the control circuit switches an output signal from the gamma correcting circuit to the non-image signal and feeds it to the plurality of data electrodes making up the liquid crystal display and wherein the moving picture parameter includes information about the gamma correction.

With the above configuration, there are some cases in which illumination of a backlight changes, a spectrum of a light source changes. At this time, by controlling a characteristic of a gamma correction to an image signal, a color characteristic of an image to be displayed can be adjusted.

Also, a preferable mode is one wherein the control circuit sets display timing with which the non-image signal is displayed on a plurality of main scanning display lines of the liquid crystal display in a manner that there is a period of time during which the display timing is overlapped while the non-image signal is displayed on the plurality of the main scanning display lines and wherein the backlight is turned OFF during a period while the display timing is overlapped or during a part of the period while the display timing is overlapped.

Also, a preferable mode is one wherein the control circuit sets the display timing with which the non-image signal is displayed on two or more main scanning display lines of the liquid crystal display so as to be different for the every two or more main scanning display lines or for every two or more blocks and turns OFF a part of the backlight corresponding to the two or more main scanning display lines or to the two or more blocks.

Also, a preferable mode is one wherein the control circuit controls display timing of the non-image signal by timing with which the non-image signal is fed to the plurality of data electrodes.

Also, a preferable mode is one wherein an image is made up of a plurality of windows and the control circuit, based on the result of detection of a motion of the image, does switching between the image signal and the non-image signal for every window and feeds switched signals to a plurality of data electrodes making up the liquid crystal display to display the image signal or the non-image signal.

With the above configuration, when a plurality of windows is displayed on a liquid crystal display, if a kind of a display content of an image signal to be displayed in each window is different, a moving picture parameter can be controlled in each window. Therefore, in this case, an image with high quality can be obtained.

Also, a preferable mode is one wherein the control circuit controls one or a plurality of moving picture parameters for every window, based on the result from detection of a motion of the image making up the window or based on the result from detection, a type of the image or a size of the window.

Also, a preferable mode is one wherein the control circuit, based on the result of detection of a motion of the image making up the window and, when having judged the image to be a moving picture, feeds the image signal and the non-image signal during one frame period to the plurality of data electrodes and, when having judged the image to be a still picture, feeds the image signal only during the one frame period two or more times to the plurality of data electrodes.

Also, a preferable mode is one wherein, wherein the moving picture parameter, when the non-image signal is displayed during one frame period, is a level of the non-image signal and illumination.

Also, a preferable mode is one wherein the control circuit, after having made a gamma correction to the image signal, switches the image signal to the non-image signal and then applies it to the plurality of data electrodes making up the liquid crystal display and wherein the moving picture parameter includes information about the gamma correction.

A preferable mode is one wherein the control circuit multiplies a specified multiplication coefficient corresponding to the moving picture parameter for the window by the image signal making up the window and feeds a result from the multiplication to the plurality of data electrodes.

A preferable mode is one wherein the multiplication coefficient is a coefficient which reduces a discontinuous change in display luminance caused by a discontinuous change of a rate at which the non-image signal making up the window is displayed during one frame period.

A preferable mode is one wherein the multiplication coefficient includes the gamma correction.

A preferable mode is one wherein the control circuit sets wherein the control circuit sets such that levels of the non-image signals and rates at which the non-image signals are displayed during one frame period are same between a plurality of windows in which the image is respectively judged to be a moving picture.

Furthermore, a preferable mode is one wherein the plurality of windows in which the image is respectively judged to be a moving picture does not share same main scanning display lines in the liquid crystal display device.

With the above configurations, switching is done between an image signal making up an image and a non-image signal, based on a result from detection of a motion of an image, a plurality of data electrodes making up the liquid crystal display device is applied in order to display the image signal and the non-image signal. Therefore, a power supply circuit to feed power to a backlight is made small-sized which reduces power consumption and is made low-priced. Moreover, the liquid crystal display device with a same level of a display characteristic as that of the CRT display which enables a flickering phenomenon, a trail-leaving phenomenon, and an image-retention phenomenon to be decreased can be obtained.

BRIEF DESCRIPTION OF THE DRAWINGS

The above and other objects, advantages, and features of the present invention will be more apparent from the following description taken in conjunction with the accompanying drawings in which:

FIG. 20 is a diagram showing a result from comparison for lighting rate of the backlight between the measure A and the measure B according to the first embodiment of the present invention;

FIG. 21 is a diagram showing a result from comparison of power consumption in the backlight among the measure A and the measure B and the case of the second conventional example;

FIG. 22 shows a result from comparison of a rate of power consumption and display luminance among a case of the second conventional example, the measure A and the measure B obtained when the blanking ratio is 0% and when the consumption power and display luminance are 100%;

FIG. 28 is a diagram illustrating one example of information of each window managed by a multi-window control circuit according to the second embodiment of the present invention;

FIGS. 29A and 29B are diagrams showing one example of "thinning-out processing" and FIG. 29A shows that a pixel block being made up of 8 pixels×8 lines is thinned out (that is, reduced) so as to be a pixel block being made up of 4 pixels×8 lines and FIG. 29B shows that a pixel block being made up of 8 pixels×8 lines is thinned out so as to be a pixel block being made up of 4 pixels×4 lines.

FIG. 35 is a diagram showing one example of a relation among a display moving picture parameter, a blanking ratio, relative luminance obtained before multiplication, multiplication coefficient and relative luminance obtained after multiplication;

DETAILED DESCRIPTION OF THE PREFERRED EMBODIMENTS

Best modes of carrying out the present invention will be described in further detail using various embodiments with reference to the accompanying drawings.

First Embodiment

Figure 1:
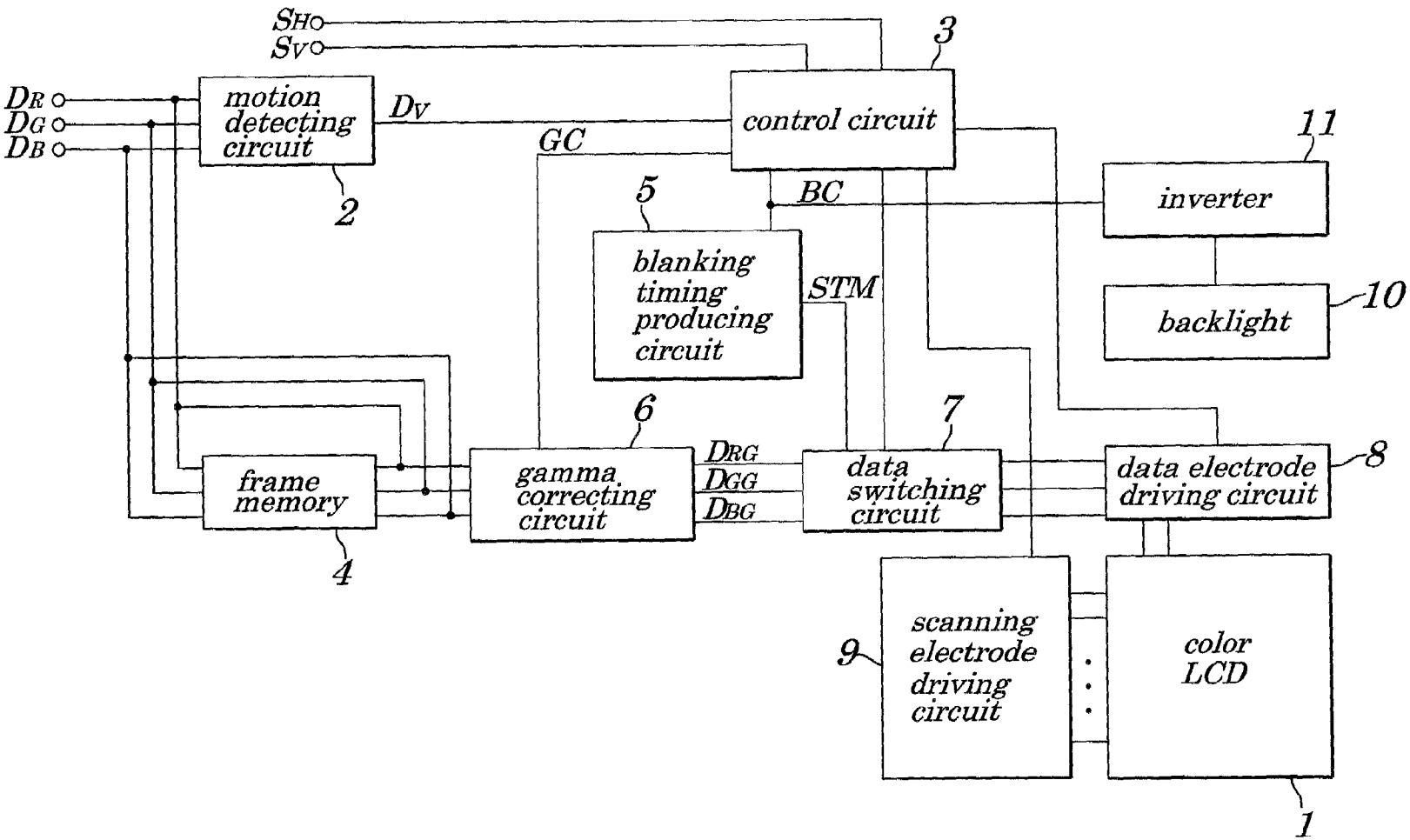
FIG. 1 is a schematic block diagram showing configurations of a liquid crystal display device according to a first embodiment of the present invention.

FIG. 1 is a schematic block diagram showing configurations of a transmissive-type liquid crystal display device employing a method for displaying an image on a color LCD according to a first embodiment of the present invention. The transmissive-type liquid crystal display device of the first embodiment includes a color LCD 1, a motion detecting circuit 2, a control circuit 3, a frame memory 4, a blanking timing producing circuit 5, a gamma correcting circuit 6, a data switching circuit 7, a data electrode driving circuit 8, a scanning electrode driving circuit 9, a backlight 10, and an inverter 11.

The color LCD 1 is an active-matrix driving-type color LCD using a TFT (Thin Film Transistor) as a switching element. In the color LCD 1 of the first embodiment, a region surrounded by a plurality of scanning electrodes (not shown) (gate lines) placed at established intervals in a row direction and by a plurality of data electrodes (not shown) (source lines) placed at established intervals in a column direction is used as a pixel (not shown). Each of the pixels of the color LCD 1 of the embodiment has a liquid crystal cell (not shown) being an equivalently capacitive load, a common electrode (not shown), a TFT (not shown) to drive a corresponding liquid crystal cell, and a capacitor (not shown) to accumulate a data electric charge for one vertical sync period. To drive this color LCD 1, while a common voltage $V_{com}$ (not shown) is being applied to the common electrode, a data red signal, a data green signal, and a data blue signal produced based respectively on a red data $D_R$, a green data $D_G$, and a blue data $D_B$ being all digital video data are fed to the data electrode and, at the same time, scanning signals produced based on a horizontal sync signal $S_H$ and a vertical sync signal $S_V$ are fed to the scanning electrode. This causes a color character, image, or a like to be displayed on a display screen of the color LCD 1. This color LCD 1 is called a WXGA (Wide Extended Graphics Array) which, in this embodiment, provides 1365×768 pixel resolution. One pixel includes three dot pixels for a red (R) color, a green (G) color, and a blue (B) color and therefore the total number of the dot pixels is "3×1365×768".

The motion detecting circuit 2 detects a plurality of motion vectors from an image being made up of the red data $D_R$, the green data $D_G$, and the blue data $D_B$ being all digital video data fed from an outside and extracts the fastest vector from the plurality of motion vectors and then feeds it as motion vector data $D_V$ to the control circuit 3. A method for detecting a motion vector from a moving picture is classified into three kinds of methods described below. A first method for detecting a motion vector is one being called a "block matching method". In the block matching method, a same technological idea as employed in a pattern matching is used. That is, whether or not a blocked region in a present image existed somewhere in a past image is checked by comparing the present image with the past image. More specifically, differential absolute values are added in every corresponding pixel in a block and a position where the differential absolute value sum becomes minimum in every block is used as a motion vector. This method provides high detecting accuracy but presents a shortcoming in that an amount of operational calculation becomes enormous.

A second method for detecting a motion vector is one being called a "gradient method". This gradient method is based on a model in which, when an image having a space gradient moves to a position, a difference in time corresponding to an amount of the motion occurs. Therefore, a motion vector can be obtained by dividing a time difference by a space gradient. In this method, a less amount of operational calculation is required, however, when an amount of movement becomes large, detecting accuracy is lowered. This is because the model described above does not fold.

A third method for detecting a motion vector is one being called a "phase correlation method". In this method, after a Fourier transformation is performed on block data existing in a position in which a present image and a past image are same, an amount of deviation in phase in a region of frequency is detected and then an inverse Fourier transformation is performed using a phase term is performed to detect a motion vector. This method is featured in that a size of a block being larger than a specified level is required to ensure detecting accuracy. This presents a problem in that an amount of operational calculation by Fourier transformation is enormous. Moreover, there is another shortcoming that, since detecting accuracy of a motion vector is equal to accuracy of a pixel to which a Fourier transformation is to be performed, a vector that can be obtained is only a motion vector of an input pixel pitch.

Moreover, for a detail of a method for detecting a motion vector and of configurations and operations of a motion vector detecting circuit, refer to Japanese Patent Application Laid-open Nos. Hei 9-93585 and Hei 9-212650.

Which moving detecting method is to be selected out of the first to third motion vector detecting methods described above can be determined, based on control accuracy required when the method of displaying the image of the present invention is employed, configurations of a control circuit employed at the time, matching in the motion vector detecting circuit, or a like.

Figures 2, 3:
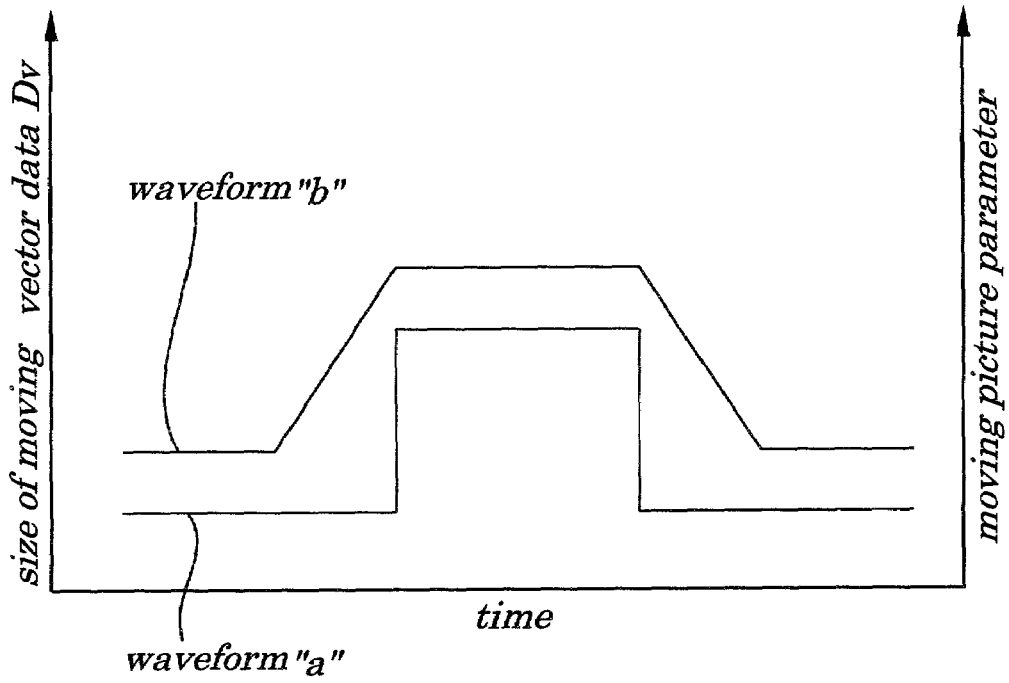
FIG. 2 is a diagram showing one example of a relation between a blanking code and a blanking ratio employed in the first embodiment.
FIG. 3 is a waveform diagram showing one example of a relation between motion vector data and moving picture parameter employed in the first embodiment.

The control circuit 3 is made up of, for example, an ASIC (Application Specific Integrated Circuit). The control circuit 3 controls the data switching circuit 7, the data electrode driving circuit 8, and the scanning electrode driving circuit 9, in response to the horizontal sync signal $S_H$ and the vertical sync signal $S_V$ fed from an outside. Also, the control circuit 3 selects a blanking code BC according to a size of motion vector data $D_V$ fed from the motion detecting circuit 2 and supplies it to the blanking timing producing circuit 5 and the inverter 11. FIG. 2 shows one example of a relation between the blanking code BC and the blanking ratio. The blanking ratio denotes a ratio of a period of time during which an image is not displayed during one frame period, that is, it is the ratio of the period of time during which a blanking is provided being expressed as a percent. The blanking ratio is designated by a value of the blanking code BC. Furthermore, the control circuit 3 produces a gamma correction code GC based on motion vector data $D_V$ fed from the motion detecting circuit 2 and supplies it to the gamma correcting circuit 6. The gamma correction code GC is explained later. Hereinafter, the blanking code BC, gamma correction code GC, and blanking level (BL) (described later), and backlight illumination are collectively called a "moving picture parameter".

The frame memory 4 is made up of a semiconductor memory such as a RAM (Random Access Memory) or a like and stores a plurality of frames of images made up of the red data $D_R$, the green data $D_G$, and the blue data $D_B$ being digital video data fed from an outside. Why the frame memory 4 is used is due to the following reasons. That is, for example, as shown by waveforms in FIG. 3, when the above motion vector data $D_V$ changes rapidly, if the moving picture parameter is changed to correspond to the rapid change, the image retention phenomenon and/or tail-leaving phenomenon occur, resulting in a decline of an image quality. When the motion vector data $D_V$ changes rapidly as shown by a waveform "a" in FIG. 3, the moving parameter is changed according to a predetermined changing rate, by several frames prior to a frame during which the rapid change of the motion vector data $D_V$ occurs, as shown by a waveform "b" in FIG. 3. This enables the reduction in the occurrence of the image-retention phenomenon and/or trail-leaving phenomenon, thus preventing the decline in the image quality.

The blanking timing producing circuit 5, based on a blanking code BC fed from the control circuit 3, produces a timing signal $S_{TM}$ (not shown) for timing with which no image is displayed and blanking is provided in a period of time out of one frame during which an image is displayed on the color LCD 1.

The gamma correcting circuit 6 provides gray scales by making a gamma correction to the red data $D_R$, the green data $D_R$, and the blue data $D_B$ being all digital video data fed from an outside or the frame memory 4, based on a gamma correction code GC fed from the control circuit 3 and then outputs them as a red data $D_{RG}$, a green data $D_{GG}$, and a blue data $D_{BG}$.

Next, the gamma correction will be explained. A reproduction characteristic of an image is expressed by a curve in a graph in which, for example, a logarithmic value of display luminance possessed originally by a subject such as a scene, a figure, or a like photographed by using a video camera is plotted as abscissa and, for example, a logarithmic value of display luminance of a reproduced image displayed by a display screen using digital video data provided from the video camera is plotted as ordinate. When an angle of inclination of the curve representing the reproduction characteristic is defined as "θ", "tan θ" is called "gamma (γ)". When the display luminance of the subject is faithfully reproduced on the display, that is, when a value in the abscissa (input) increments by one while a value in the ordinate (output) also increments by one, the curve representing the reproduction characteristic becomes a straight line having an angle of inclination being 45° and, since tan 45°=1, the gamma becomes 1 (one). Therefore, to reproduce display luminance of a subject faithfully, gamma (γ) of an entire system including a video camera used for photography of a subject and a display used for reproduction of an image has to be "1". However, each of an imaging device such as a CCD (Charge Coupled Device) making up a video camera or a CRT display has its own gamma. The gamma of the CCD is "1" and the gamma of the CRT display is about "2.2". To make a gamma correction to an entire system be "1" and to obtain a reproduced image having a better gray scale, it is necessary to make a correction to digital video data and this correction is called a "gamma correction". Generally, a gamma correction is made to digital video data so as to have the data match a gamma characteristic of a CRT display.

Figure 4:
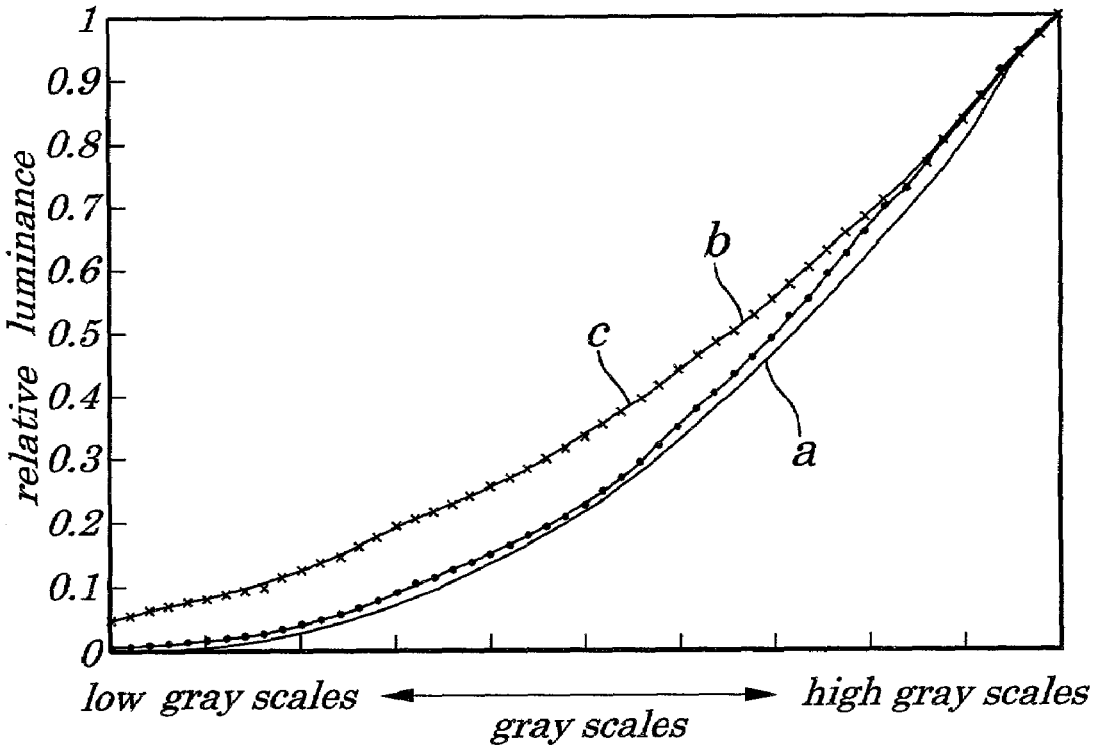
FIG. 4 is one example of a gamma characteristic curve for a color LCD and CRT display.

FIG. 4 shows a characteristic curve (gamma curve) of display luminance (output) to a gray scale (input) of a CRT display and the color LCD 1. In FIG. 4, a curve "a" is a gamma characteristic curve of a CRT display and a curve "b" is a gamma characteristic curve obtained when a white image is continuously displayed during one frame period on the color LCD 1. Hereinafter, a case in which a still picture is displayed on the color LCD 1 is called a "case of ordinary driving". A curve "c" is a gamma characteristic curve obtained when, to display a moving picture on the color LCD 1, an image signal is displayed for a period of time being equivalent to 50% in a first half out of one frame period and a non-image signal is displayed for a period of time being equivalent to 50% in a latter half out of one frame period and when a blanking level BL of the non-image signal is 127/255. The blanking level BL is a specified voltage level to have a black color displayed on the color LCD 1 and a white level in a normal image signal is expressed as 255/255 and a black level in the normal image signal is expressed as 0/255. Originally, though the blanking level BL is ideally 0/255, however, in that case, as described above, display luminance decreases as a ratio of the blanking signal becomes high. To prevent a decrease in display luminance and to improve the display luminance, the blanking level BL is made higher than 0/255. In this case, a black color floats, that is, black display becomes bright and therefore gamma characteristic changes. Conversely speaking, even if a blanking ratio is increased by the blanking code BC, theoretically, if the blanking level BL remains 0/255, the gamma characteristic does not change. On the other hand, since display luminance decreases due to an increased ratio of the blanking, it becomes necessary to raise backlight illumination BB (not shown). However, when the backlight illumination BB is raised, generally, power consumption by a power source increases. Moreover, there is limitation when illumination is controlled by changing power by a characteristic of the backlight. If the backlight illumination BB is merely raised, a change in the gamma characteristic of an LCD does not occur. Actually, however, in some cases, spectral distribution of the backlight is changed by an increased backlight illumination BB. In this case, since a gamma characteristic of an LCD changes, in the liquid crystal display device shown in FIG. 1, it is necessary to select a proper gamma correction code GC according to moving picture parameters such as the blanking code BC, the blanking level BL, and the backlight illumination BB. Moreover, there is a difference, apparently, in most suitable gamma characteristics between patterns to be displayed in a color LCD 1, for example, between a binary image and an image such as a photograph. A gamma correction code GC is not always selected only according to the blanking code BC, the blanking level BL, or the backlight illumination BB. Therefore, in the embodiment, the gamma correction code GC is added to a moving picture parameter.

Thus, in FIG. 1, the control circuit 3, based on a motion vector data $D_V$ fed from the moving detecting circuit 2 and a control signal fed from a display control section (not shown), produces a gamma correction code GC and feeds it to the gamma correcting circuit 6. Here, the control signal fed from the display control section is a signal used to make a characteristic of an image to be displayed be suited to a preference of an observer. Moreover, in FIG. 4, display luminance is expressed as relative display luminance obtained when the display luminance at a time of display at a highest gray scale on each display is defined to be "1".

As is apparent from FIG. 4, even if a picture is displayed on the same color LCD 1, there is a difference in the gamma characteristic between in the case of ordinary driving in which a still picture is displayed and in the case in which a moving picture is displayed. Therefore, the gamma correcting circuit 6, based on the gamma correction code GC fed from the control circuit 3, makes a different gamma correction to each of the red data $D_R$, the green data $D_G$, and the blue data $D_B$ between in the case of ordinary driving in which a still picture is displayed and in the case in which a moving picture is displayed. The gamma correction code GC is set to be "0" when all of the red data $D_R$, the green data $D_G$, and the blue data $D_B$ are judged to be still pictures and an instruction for displaying the still picture is issued, while it is set to be "1" when all of the red data $D_R$, the green data $D_G$, and the blue data $D_B$ are judged to be moving pictures and an instruction for displaying the moving picture is issued. Moreover, in the color LCD 1, a characteristic curve (V-T characteristic curve) representing transmittance T to a voltage V applied to a data electrode is not linear and a change in the transmittance T to a change in the applied voltage V is small in the vicinity of an area in which there is a black level display. Additionally, since the V-T characteristic curve is different in each of the red, the green, and the blue colors, the gamma characteristic curve is different in each of the red, the green, and the blue colors. Therefore, the gamma correction circuit 6 makes a gamma correction individually to each of the red data $D_R$, the green data $D_G$, and the blue data $D_B$ so that each of them can match the characteristic of the transmittance T of each of the red, the green, and the blue colors to a voltage applied to the data electrode.

The data switching circuit 7 does switching between the red data $D_{RG}$, the green data $D_{GG}$, and the blue data $D_{BG}$ and the blanking signal, based on a timing signal $S_{TM}$ being controlled by the control circuit 3 and being fed from the blanking timing producing circuit 5 and outputs the switched data. Here, the blanking signal represents a signal to have a black color displayed on the color LCD 1, and each of the red data $D_{RG}$, the green data $D_{GG}$, and the blue data $D_{BG}$ is a specified voltage value (that is, blanking level BL) to have a black color displayed on the color LCD 1.

The data electrode driving circuit 8, with timing in which each of the control signals is fed from the control circuit 3, selects a gray-scale voltage specified by the red data $D_{RG}$, the green data $D_{GG}$, the blue data $D_{BG}$ or the blanking signal fed from the data switching circuit 7 and applies each of the selected voltages as a data red signal, data green signal, and data blue signal to a corresponding data electrode in the color LCD 1. The scanning electrode driving circuit 9, with timing in which a control signal is fed from the control circuit 3, sequentially produces a scanning signal and sequentially applies the produced signal to a corresponding scanning electrode in the color LCD 1.

The backlight 10 is made up of a light source and a light diffusing member used to diffuse light emitted from the light source and to use the light source as a flat light source and illuminates a rear of the color LCD 1 being a non-emissive device itself. The light source of the backlight 10 includes a fluorescent tube, high-voltage discharging lamp, plane fluorescent lamp, electroluminescence element, light-emitting element such as a white light emitting diode, or a like.

Figure 5:
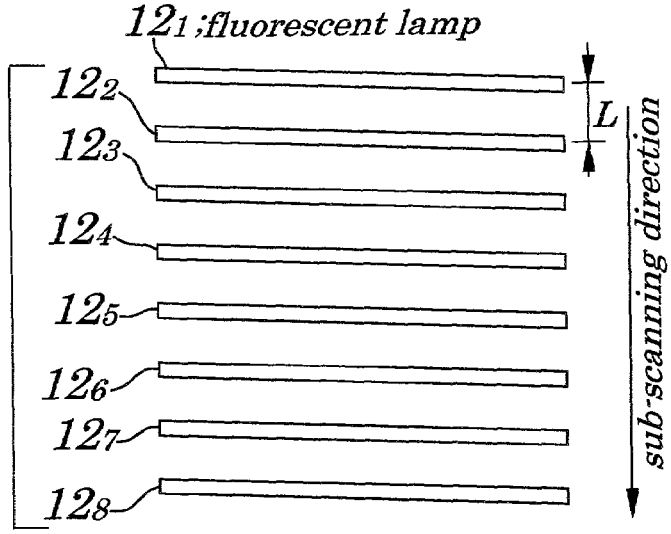
FIG. 5 is a schematic top view showing an example of arrangements of fluorescent lamps making up a backlight employed in the LCD of the first embodiment.
Figure 6:
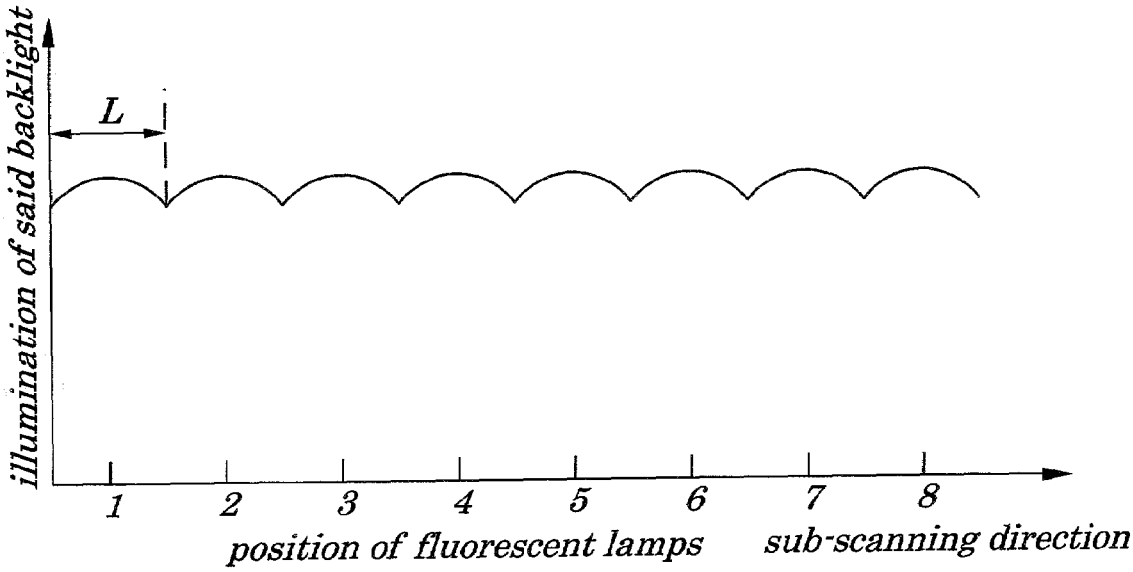
FIG. 6 is a diagram illustrating illuminations of the backlight obtained when all fluorescent lamps are turned ON according to the first embodiment.

FIG. 5 shows a schematic top view of the backlight 10 using eight pieces of fluorescent lamps $\mathbf{12}_1$ to $\mathbf{12}_8$ as the light source. As shown in FIG. 5, the fluorescent lamps $\mathbf{12}_1$ to $\mathbf{12}_8$ are arranged at specified intervals L in a sub-scanning direction, that is, in a row direction of the color LCD 1. FIG. 6 is a diagram illustrating illuminations of the backlight 10 obtained when all fluorescent lamps $\mathbf{12}_1$ to $\mathbf{12}_8$ are turned ON. The inverter 11 flashes on the backlight 10 based on a blanking code BC fed from the control circuit 3.

Next, operations of the liquid crystal display device having configurations described above will be explained below. First, a gamma correction is made to each of the red data $D_R$, the green data $D_G$, and the blue data $D_B$ fed from an outside during a period of time being equivalent to one-fourth of one frame period and the gamma-corrected data are fed respectively as the red data $D_{RG}$, the green data $D_{GG}$, and the blue data $D_{BG}$ to the data electrode driving circuit 8.

Next, an outline of operations of the liquid crystal display device of the first embodiment will be described below. First, the motion detecting circuit 2 detects a plurality of motion vectors out of an image made up of the red data $D_R$, the green data $D_G$, and the blue data $D_B$ being digital video data fed from an outside. Moreover, the frame memory 4 stores aplurality of frames of images made up of the red data $D_R$, the green data $D_G$, and the blue data $D_B$ being digital video data. Then, the moving detecting circuit 2 extracts the fastest motion vector out of the plurality of the detected motion vectors and feeds it as a motion vector data $D_V$ to the control circuit 3. This causes the control circuit 3 to produce a blanking code BC and a gamma correction code GC based on the motion vector data $D_V$. At this point, the control circuit 3, when the motion vector data $D_V$ changes rapidly as shown by the waveform "a" shown in FIG. 3, changes the moving picture parameter according to a predetermined changing rate, by several frames prior to the frame during which the rapid change of the motion vector data $D_V$ occurs, as shown by the waveform "b" in shown FIG. 3 and outputs the changed moving picture parameter. Then, the control circuit 3 feeds a blanking code BC to both the blanking timing producing circuit 5 and the inverter 11 and, at the same time, feeds a gamma correction code GC to the gamma correcting circuit 6. Moreover, the control circuit 3, based on the horizontal sync signal $S_H$, the vertical sync signal $S_V$, or a like, controls the data switching circuit 7, the data electrode driving circuit 8 and the scanning electrode driving circuit 9. Therefore, the blanking timing producing circuit 5, based on a blanking code BC fed from the control circuit 3, produces a timing signal $S_{TM}$ and feeds it to the data switching circuit 7. Moreover, the gamma correcting circuit 6 makes a gamma correction to the red data $D_R$, the green data $D_G$, and the blue data $D_B$ being digital video data fed from an outside or from the frame memory 4 to provide gray scales to them, based on a gamma correction code GC and then outputs them as the red data $D_{RG}$, the green data $D_{GG}$, and the blue data $D_{BG}$. The data switching circuit 7 is controlled by the control circuit 3 and does switching between each of the red data $D_{RG}$, the green data $D_{GG}$, and the blue data $D_{BG}$ and the blanking signal being fed from the gamma correcting circuit 6, based on a timing signal $S_{TM}$ being fed from the blanking timing producing circuit 5 and outputs the switched data. Therefore, the data electrode driving circuit 8, with timing in which each of the control signals is fed from the control circuit 3, selects a gray-scale voltage specified by the red data $D_{RG}$, the green data $D_{GG}$, and the blue data $D_{BG}$ fed from the data switching circuit 7 and applies each of the selected voltages as a data red signal, data a green signal, and a data blue signal to a corresponding data electrode in the color LCD 1. Moreover, the scanning electrode driving circuit 9, with timing in which a control signal is fed from the control circuit 3, sequentially produces a scanning signal and sequentially applies the produced signal to a corresponding scanning electrode in the color LCD 1. At the same time, the inverter 11 flashes eight pieces of the fluorescent lamps ($\mathbf{12}_1$, to $\mathbf{12}_{18}$) making up the backlight 10, based on a blanking code BC fed from the control circuit 3.

This enables a display of a color image of high quality made up of moving pictures and still pictures on the color LCD 1 with reduced power consumption.

Next, reduction of power consumption in the backlight 10 will be described in detail. In the embodiment, in order to reduce power consumption in the backlight 10, a measure A and a measure B are taken. As the measure A, all the eight pieces of fluorescent lamps $\mathbf{12}_1$ to $\mathbf{12}_8$ shown in FIG. 5 are flashed simultaneously. As the measure B, the eight pieces of fluorescent lamps $\mathbf{12}_1$ to $\mathbf{12}_8$ shown in FIG. 5 are sequentially flashed according to scanning of a corresponding scanning electrode in the color LCD 1.

(1) In the case of the measure A:

FIGS. 7 to 11 show waveforms of scanning signals $Y_1$ to $Y_{768}$ to be fed to 768 pieces of scanning electrodes in the color LCD 1 and waveforms of a backlight control signal $S_L$ obtained when the measure A is taken. In the scanning signals $Y_1$ to $Y_{768}$ shown in FIGS. 7 to 11, $P_D$ is an image writing pulse which turns ON all TFTs being connected to a corresponding scanning electrode and goes high to write an image signal in a liquid crystal cell to be driven by the TFTS. Similarly, in the scanning signals $Y_1$ to $Y_{768}$ shown in FIGS. 7 to 11, $P_B$ is a blanking writing pulse which turns ON all the TFTs being connected to a corresponding scanning electrode and goes high to write a blanking signal in a liquid crystal cell to be driven by the TFTs.

Figure 7:
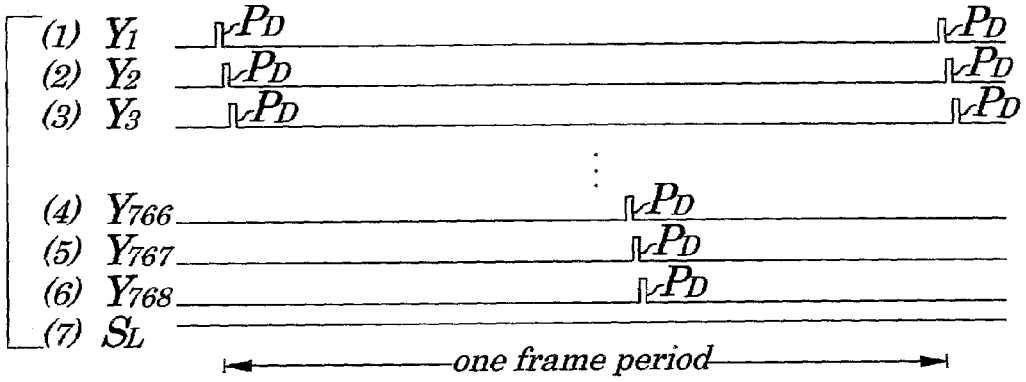
FIG. 7 is a diagram illustrating waveforms of scanning signals and waveforms of a backlight control signal occurring when a measure A is taken with a blanking ratio being set to be 0% according to the first embodiment of the present invention.
Figure 8:
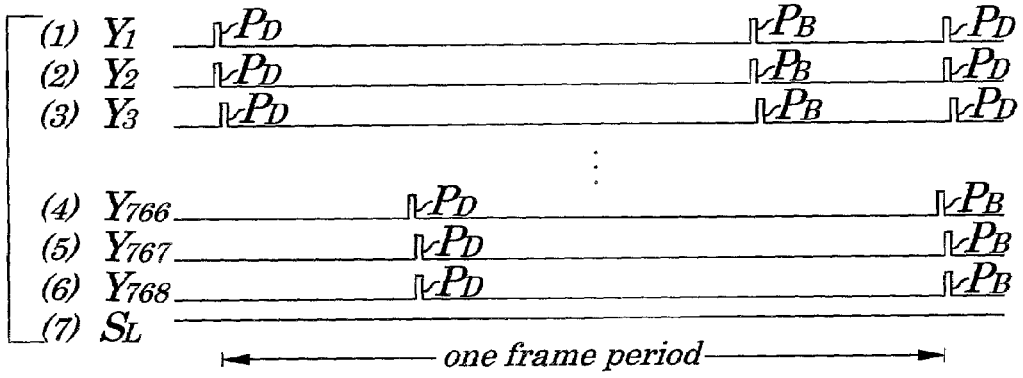
FIG. 8 is a diagram illustrating waveforms of scanning signals in frames in odd-numbered order and waveforms of a backlight control signal when the measure A is taken with the blanking ratio being set to be 25% according to the first embodiment of the present invention.
Figure 9:
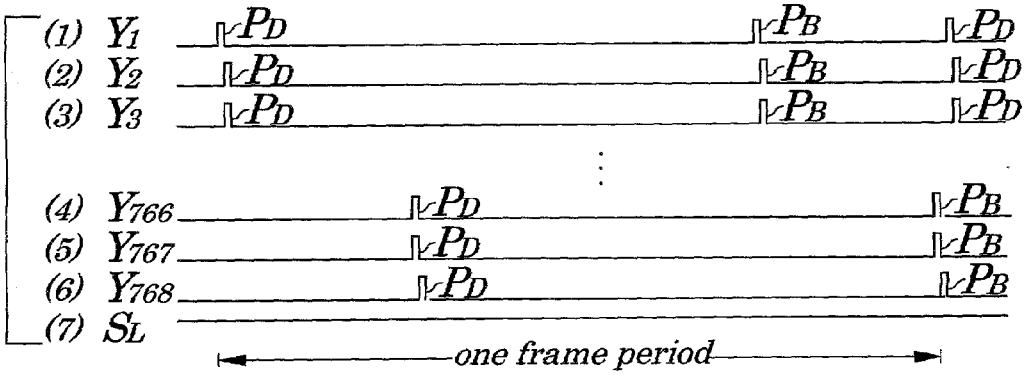
FIG. 9 is a diagram illustrating waveforms of scanning signals in frames in even-numbered order and waveforms of the backlight control signal when the measure A is taken with the blanking ratio being set to be 25% according to the first embodiment of the present invention.

FIG. 7 shows a case in which the blanking code BC is "0", that is, the blanking ratio is 0%. In FIG. 7, since the blanking ratio is 0%, in each of scanning signals $Y_1$ to $Y_{768}$, timing is deviated by a period of time being equivalent to the image writing pulse $P_D$. Moreover, as shown in FIG. 7(7), the backlight control signal $S_L$ is high at all times, that is, all eight pieces of fluorescent lamps $\mathbf{12}_1$ to $\mathbf{12}_8$ during an entire one frame period are turned ON. Moreover, each of scanning signals $Y_1$ to $Y_{768}$ shown in FIG. 7(1) to (6) is applied to a corresponding scanning electrode during frames in odd-numbered and even-numbered order in a same manner. FIGS. 8 and 9 show examples in which the blanking code BC is "10", that is, the blanking ratio is 25%. The scanning signals $Y_1$ to $Y_{768}$ shown in FIG. 8(1) to (6) are applied when the frame is in odd-numbered order and the scanning signals $Y_1$ to $Y_{768}$ shown in FIG. 9(1) to (6) are applied when the frame is in even-numbered order. As is apparent in (1) and (2), and (5) and (6) in FIG. 8, each of a scanning signal $Y_{2n-1}$ existing in odd-numbered order and a subsequent scanning signal $Y_{2n}$ (n is a natural number) existing in even-numbered order has a same waveform. On the other hand, each of a scanning signal $Y_{2n}$ existing in even-numbered order and a subsequent scanning signal $Y_{2n}$ (n is a natural number) existing in odd-numbered order has a same waveform. That is, in the embodiment, during the frame in odd-numbered order, by simultaneously scanning both the scanning signal $Y_{2n-1}$ existing in the odd-numbered order and the scanning signal $Y_{2n}$ existing in the even-numbered order, a same signal is simultaneously transferred to a TFT of a corresponding pixel. During the frame in even-numbered order, by simultaneously scanning both the scanning signal $Y_{2n}$ existing in the even-numbered order and the scanning signal $Y_{2n-1}$ existing in the odd-numbered order, a same signal is simultaneously transferred to a TFT of a corresponding pixel. Therefore, time required for the scanning can be reduced to half when compared with the case of scanning for one line. However, if such the displaying method is employed, since a main scanning line density for display is reduced to a half, display resolution is lowered. This display method is frequently used when an interlace signal used in such the NTSC system is displayed on an LCD. The number of the valid main scanning lines for an image signal being employed in such the NTSC system is about 480, and one frame is made up of two fields and a first field is made up of only odd line signals and a second filed is made up of only even line signals. Each of the odd frame and the even frame corresponds respectively to each of the above first field and the second field. On the other hand, in the embodiment, since the number of pixels in a longitudinal direction in the color LCD 1 is 768, in order to display an image signal being employed in the NTSC system, a change in the scanning line is required. However, when the number of pixels in a longitudinal direction in the color LCD is 480, an image signal in a first field of an image signal being employed in the NTSC system can be displayed, as it is, during the odd frame while an image signal in a second field of an image signal being employed in the NTSC system can be displayed, as it is, during the even frame. In contrast, when data is displayed in the color LCD, by simply "thinning out" an image signal and simultaneously scanning a scanning signal $Y_{2n-1}$ existing in odd-numbered order and a subsequent scanning signal $Y_{2n}$ existing in even-numbered order at all times, without differentiating between the frame in odd-numbered frame and in even-numbered frame, a same signal can be simultaneously transferred through two lines to each of TFTs of corresponding pixels. However, the display resolution is reduced to a half.

By employing the driving method described above, display luminance being almost equal to the display luminance that can be obtained even if such the double scanning method as employed in the second conventional example is not employed. Therefore, in the above embodiment, the color LCD 1, data electrode driving circuit 8 and scanning electrode driving circuit 9 can be configured so as to be simpler. In FIGS. 8 and 9, since the blanking ratio is 25%, timing for writing the image writing pulse $P_D$ is a little deviated in each of the scanning signals $Y_1$ to $Y_{768}$ and timing for the blanking pulse $P_B$ is a little deviated by a period of time being three-fourth of one frame between two pieces of image writing pulses $P_D$. Moreover, as shown in FIG. 8(7) and FIG. 9 (7), the backlight control signal $S_L$ is high at all the time, that is, all the eight pieces of fluorescent lamps $\mathbf{12}_1$ to $\mathbf{12}_8$ are turned ON during an overall one frame period.

Figure 10:
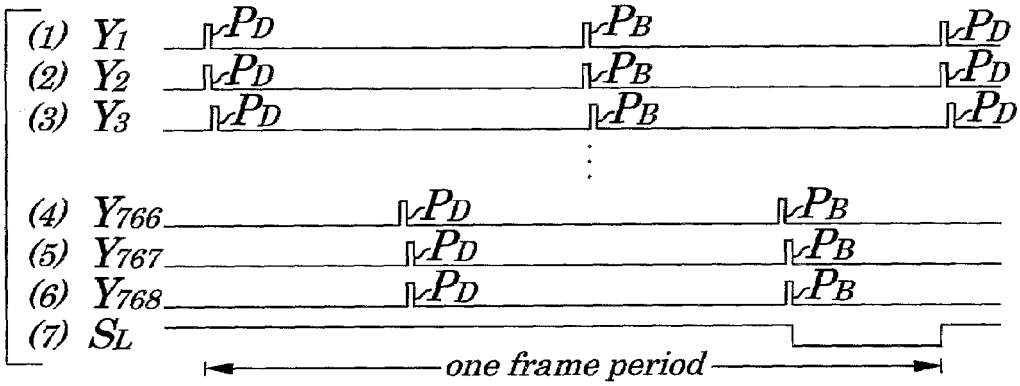
FIG. 10 is a diagram illustrating waveforms of scanning signals in frames in odd-numbered order and waveforms of a backlight control signal when the measure A is taken with the blanking ratio being set to be 50% according to the first embodiment of the present invention.

FIG. 10 shows an example in which the blanking code BC is "20", that is, the blanking ratio is 59% and the scanning signals $Y_1$ to $Y_{768}$ shown in FIG. 10(1) to (6) are applied to a case when the frame is in odd-numbered order. As is apparent in (1) and (2), and (5) and (6) in FIG. 8, a scanning signal $Y_{2n-1}$ existing in odd-numbered order and a subsequent scanning signal $Y_{2n}$ (n is a natural number) existing in even-numbered order has a same waveform. Moreover, though the case of a frame existing in even-numbered order is not shown, timing is different from the case shown in FIG. 9 and the scanning signal $Y_{2n-1}$ existing in even-numbered order and a subsequent scanning signal $Y_{2n}$ (n is a natural number) existing in odd-numbered order has a same waveform. In FIG. 10, since the blanking ratio is 50%, timing for writing the image writing pulse $P_D$ is a little deviated in each of the scanning signals $Y_1$ to $Y_{768}$ and timing for the blanking pulse $P_B$ is a little deviated by a period of time being one half of one frame between two pieces of image writing pulses $P_D$. Moreover, as shown in FIGS. 10(1) and 10(6), during a period of time existing after three fourth in one frame period, only blanking pulse $P_B$ occurs in each of the scanning signals $Y_1$ to $Y_{768}$ and blanking display appears on all the scanning lines. Therefore, as shown in FIG. 10(7), the backlight control signal $S_L$ goes low during a period of time existing after three-fourth in one frame period, that is, during the period of time existing after three-fourth in one frame period, all the eight pieces of fluorescent lamps $\mathbf{12}_1$ to $\mathbf{12}_8$ are turned OFF.

Figure 11:
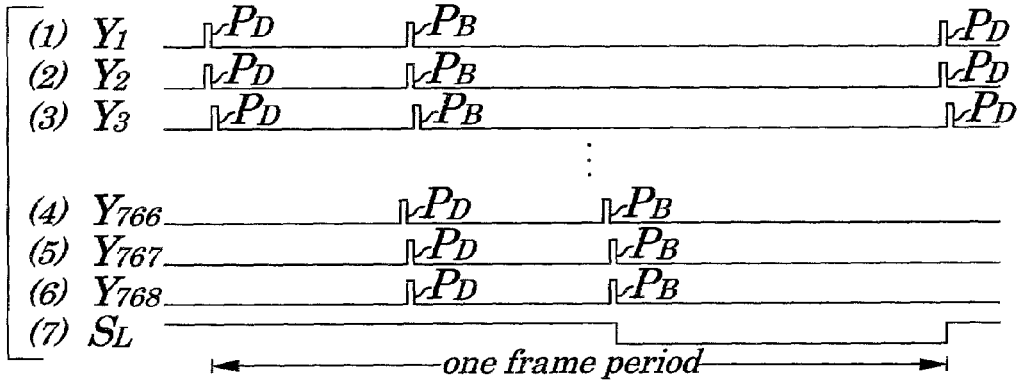
FIG. 11 is a diagram illustrating waveforms of scanning signals in frames in odd-numbered order and waveforms of the backlight control signal when the measure A is taken with the blanking ratio being set to be 75% according to the first embodiment of the present invention.

In FIG. 11, a case in which the blanking code BC is "30", that is, a case in which the blanking ratio is 75%, the scanning signals $Y_1$ to $Y_{768}$ shown in FIG. 11(1) to (6) are fed when a frame is in odd-numbered order. In FIG. 11, as shown in FIG. 11(1) and (2), and FIG. 11(5) and 11(6), a scanning signal $Y_{2n-1}$ existing in odd-numbered order and a subsequent scanning signal $Y_{2n}$ (n is a natural number) existing in even-numbered order has a same waveform. Moreover, though the case of a frame existing in even-numbered order is not shown, timing only is different from a case shown in FIG. 9 and each of a scanning signal $Y_{2n}$ existing in even-numbered order and a subsequent scanning signal $Y_{2n+1}$ (n is a natural number) existing in odd-numbered order has a same waveform.

In FIG. 11, since the blanking ratio is 75%, timing for writing the image writing pulse $P_D$ is a little deviated in each of the scanning signals $Y_1$ to $Y_{768}$ and timing for the blanking pulse $P_B$ is a little deviated by a period of time being one-fourth of one frame between two pieces of image writing pulses $P_D$. Moreover, as shown in FIGS. 11(1) and 11(6), during a period of time existing one-half in one frame period, only blanking pulse $P_B$ occurs in each of the scanning signals $Y_1$ to $Y_{768}$ and blanking display appears on all the scanning lines. Therefore, in shown in FIG. 11(7), the backlight control signal $S_L$ goes low during a period of time existing after one-half in one frame period, that is, during the period of time existing after one-half in one frame period, all the eight pieces of fluorescent lamps $\mathbf{12}_1$ to $\mathbf{12}_8$ are turned OFF.

Next, for comparison, in the second conventional example employing the double-scanning method, when the blanking ratio is 0%, 25%, 50%, and 75%, a waveform of each of the scanning signals $Y_1$ to $Y_{384}$ is shown in FIG. 12 to FIG. 15. In the scanning signals $Y_1$ to $Y_{384}$ shown in FIG. 12 to FIG. 15, $P_D$ represents the above image writing pulse and $P_B$ is the above blanking pulse. The double scanning method represents a method in which each of image signals is transferred to a TFT of each of corresponding images corresponding to each of scanning lines by simultaneously performing scanning on eight pieces of the scanning lines. When the double scanning method is shown in FIGS. 12 to 15, is employed, the scanning signal $Y_1$ and scanning signal $Y_{192}$ are simultaneously scanned and then the scanning signal $Y_2$ to scanning signal $Y_{194}$ are simultaneously scanned sequentially and finally the scanning signal $Y_{193}$ and scanning signal $Y_{384}$ are simultaneously scanned and the scanning operation in one frame ends. Thus, in the double scanning method, in order to simultaneously transfer an image signal corresponding to two scanning lines, a scale of a circuit of the data electrode driving circuit 8 is doubled. However, in the double scanning method, time required for scanning without a decrease in main scanning resolution can be reduced to a half.

Figure 12:
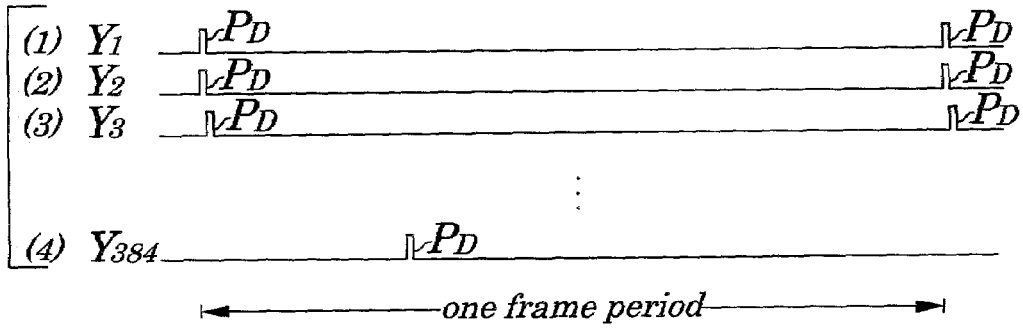
FIG. 12 is a diagram illustrating waveforms of scanning signals in frames in odd-numbered order and waveforms of a backlight control signal when a blanking ratio is set to be 0% according to a second conventional example.
Figure 13:
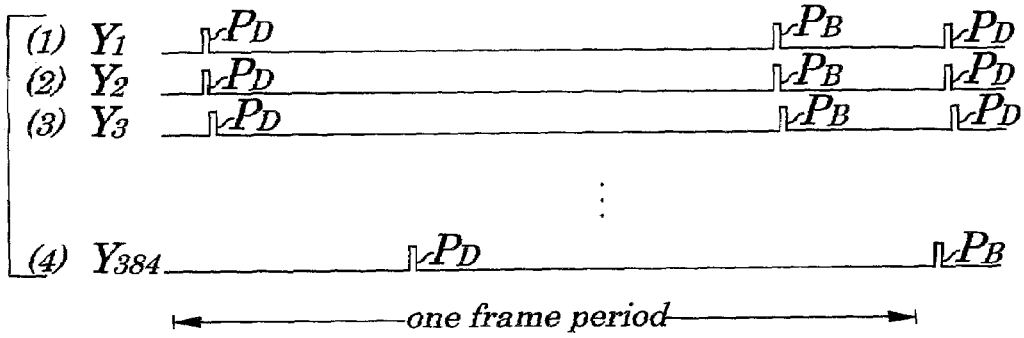
FIG. 13 is a diagram illustrating waveforms of scanning signals in frames in odd-numbered order and waveforms of the backlight control signal when the blanking ratio is set to be 25% according to the second conventional example.

In FIG. 12, if the blanking code BC is "0", that is, if the blanking ratio is "0%", in each of the scanning signals $Y_1$ to $Y_{768}$, timing of only the image writing pulse $P_D$ is deviated a little by a period of time being one-fourth of one frame. FIG. 13 shows a case in which the blanking code BC is "10", that is, a case in which the blanking ratio is 25%. In FIG. 13, since the blanking ratio is 25%, timing for writing the image writing pulse $P_D$ is a little deviated by a period of time being one-fourth of one frame period in each of the scanning signals $Y_1$ to $Y_{768}$ and timing for the blanking pulse $P_B$ is a little deviated by a period of time being three-fourth of one frame between two pieces of image writing pulses $P_D$.

Figure 14:
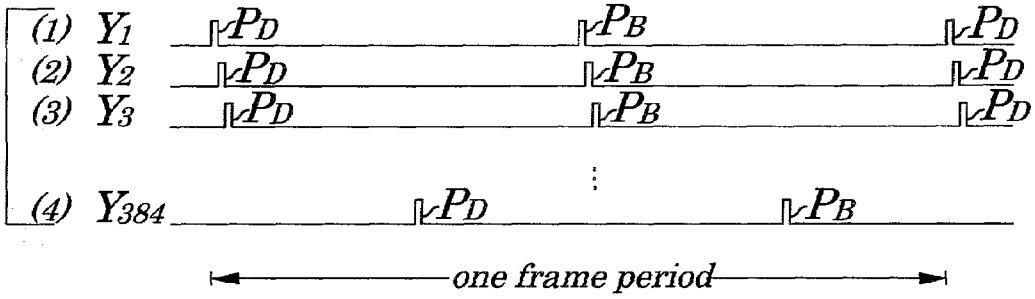
FIG. 14 is a diagram illustrating waveforms of scanning signals in frames in odd-numbered order and waveforms of the backlight control signal when the blanking ratio is set to be 50% according to the second conventional example.
Figure 15:
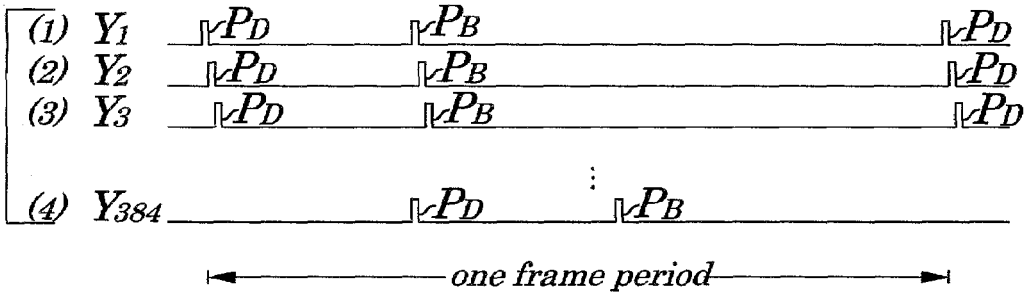
FIG. 15 is a diagram illustrating waveforms of scanning signals in frames in odd-numbered order and waveforms of the backlight control signal when the blanking ratio is set to be 75% according to the second conventional example.

FIG. 14 shows a case in which the blanking code BC is "20", that is, the blanking ratio is 50%. In FIG. 14, since the blanking ratio is 50%, timing for writing the image writing pulse $P_D$ is a little deviated by a period of time being one-fourth of one frame period in each of the scanning signals $Y_1$ to $Y_{768}$ and timing for the blanking pulse $P_B$ is a little deviated by a period of time being one-half of one frame between two pieces of image writing pulses $P_B$. In FIG. 15, since the blanking code BC is 30, that is, the blanking ratio is 75%, timing for writing the image writing pulse $P_D$ is a little deviated by a period of time being one-fourth of one frame period in each of the scanning signals $Y_1$ to $Y_{768}$ and timing for the blanking pulse $P_B$ is a little deviated by a period of time being one-fourth of one frame between two pieces of image writing pulses $P_B$.

Moreover, results of comparison in the above measure A and the second conventional example are described later.

Figure 16:
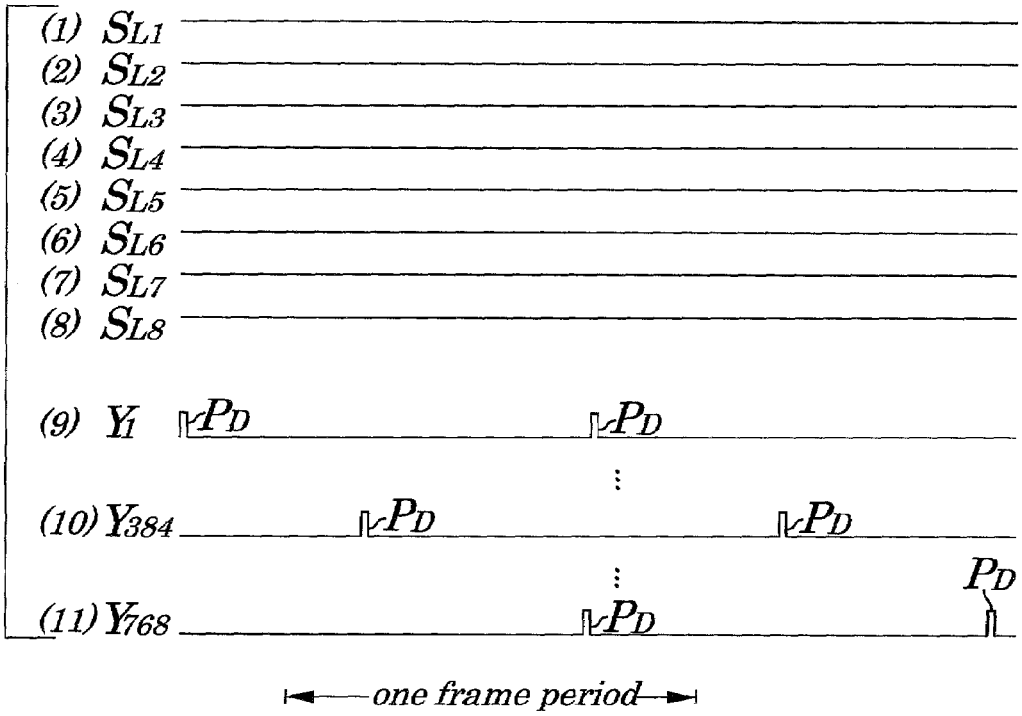
FIG. 16 is a diagram illustrating waveforms of backlight control signals obtained when a blanking ratio is 0% in a measure B and waveforms of scanning signals according to the first embodiment of the present invention.

(2) In the case of measure B:

In FIGS. 16 to 19, waveforms of backlight control signals $S_{L1}$ to $S_{L8}$ obtained when the measure B is taken and 768 pieces of waveforms of scanning signals $Y_1$ to $Y_{768}$ in the color LCD 1 are shown. In each of the scanning signals $Y_1$ to $Y_{768}$ shown in FIG. 16 to FIG. 19, when the blanking code BC is "0", that is, the blanking ratio is "0%". In FIG. 16, since the blanking ratio is 0%, as shown in FIGS. 16(9) to 16(11), in each of the scanning signals $Y_1$ to $Y_{768}$, timing of the image writing pulse $P_D$ only is deviated a little. Moreover, as shown in 16(1) to 16(8), the backlight control signals $S_{L1}$ to $S_{L8}$ are "high" at all the time, that is, eight pieces of the fluorescent lamps $\mathbf{12}_1$ to $\mathbf{12}_8$ during an entire one frame period are turned ON.

Figure 17:
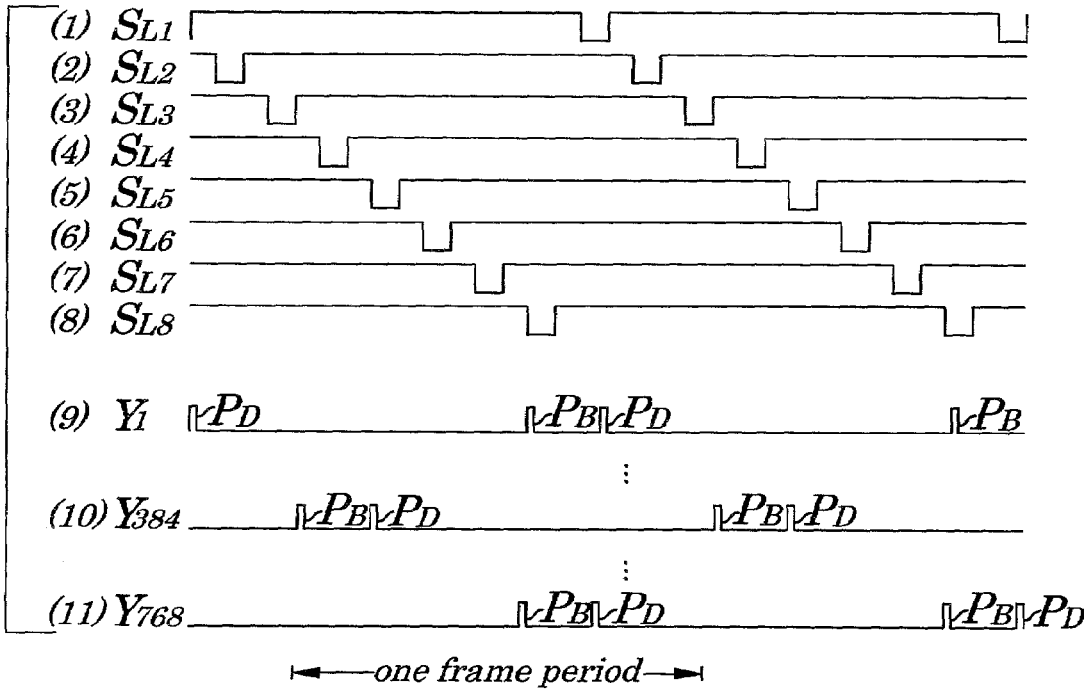
FIG. 17 is a diagram illustrating waveforms of backlight control signals obtained when a blanking ratio is 25% in the measure B and waveforms of scanning signals according to the first embodiment of the present invention.

In FIG. 17, when the blanking code BC is "10", that is, the blanking ratio is 25%. In FIG. 11, since the blanking ratio is 25%, as shown in FIG. 17, in each of the scanning signals $Y_1$ to $Y_{768}$, timing of the image writing pulse $P_D$ is a little deviated and timing for the blanking pulse $P_B$ is a little deviated by a period of time being three-fourth of one frame between two pieces of image writing pulses $P_D$. Moreover, as shown in FIG. 17(1) to 17(8), though timing of backlight control signals $S_{L1}$ to $S_{L8}$ is deviated a little and goes low, no signal goes low at the same time. This causes any one of the eight pieces of the fluorescent lamps $\mathbf{12}_1$ to $\mathbf{12}_8$ to light up during one frame period.

Figure 18:
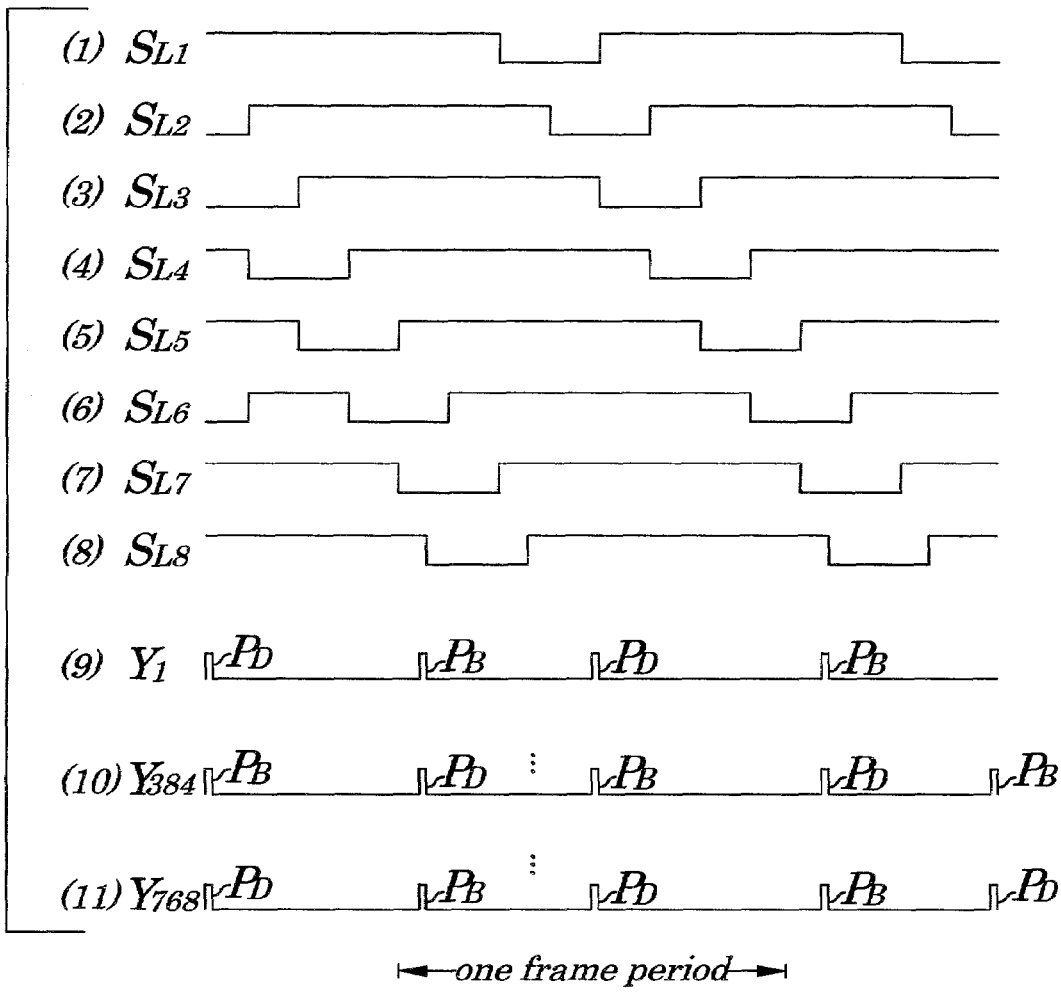
FIG. 18 is a diagram illustrating waveforms of backlight control signals obtained when a blanking ratio is 50% in the measure B and waveforms of scanning signals according to the first embodiment of the present invention.

In FIG. 18, the blanking code BC is "20", that is, the blanking ratio is 50%. In FIG. 18, since the blanking ratio is 50%, in each of the scanning signals $Y_1$ to $Y_{768}$, as shown in FIG. 18(9) to 18(11), timing of the image writing pulse $P_D$ is a little deviated and timing for the blanking pulse $P_B$ is a little deviated by a period of time being one-half of one frame between two pieces of image writing pulses $P_B$. As shown in FIGS. 18(1) to 18(8), each of the backlight control signals $S_{L1}$ to $S_{L8}$ is a little deviated and goes low only during one-fourth of one frame period.

Figure 19:
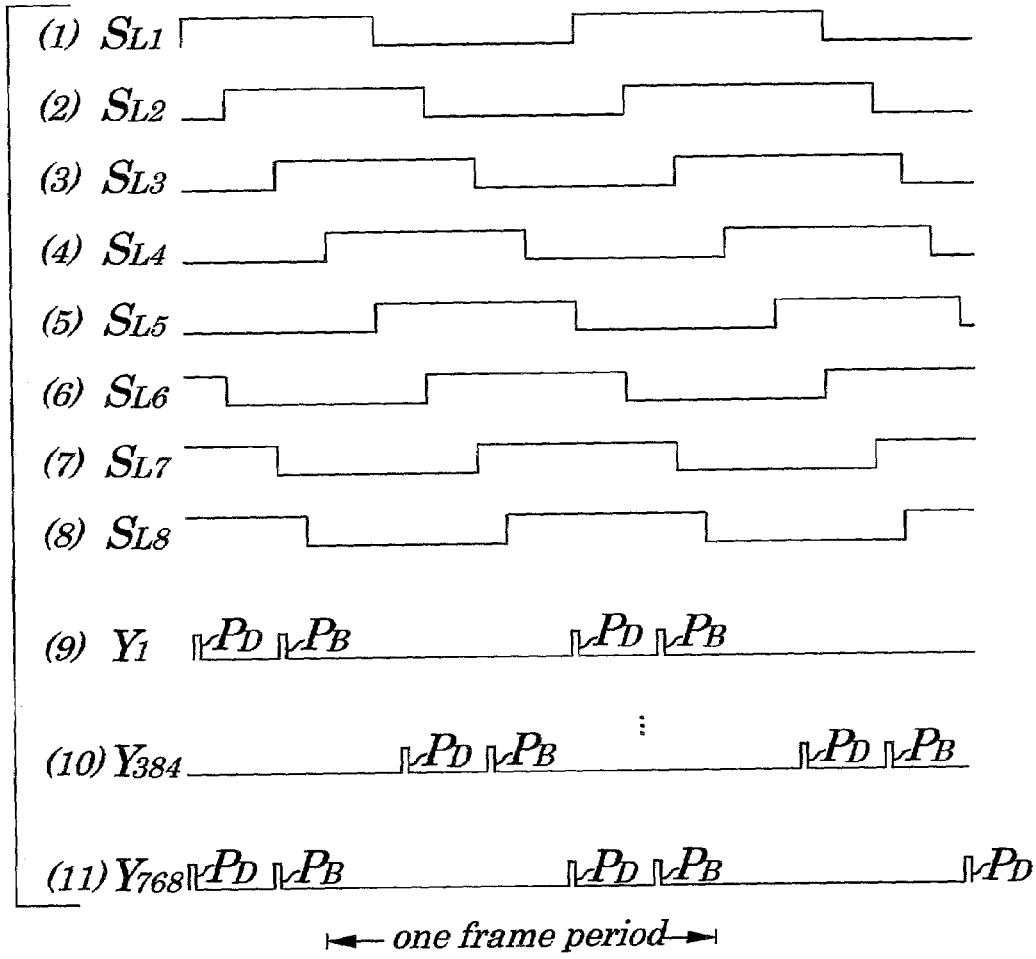
FIG. 19 is a diagram illustrating waveforms of backlight control signals obtained when a blanking ratio is 75% in the measure B and waveforms of scanning signals according to the first embodiment of the present invention.

FIG. 19 shows a case in which the blanking code BC is "30", that is, when the blanking ratio is "75%". In FIG. 19, since the blanking ratio is 75%, as shown in FIGS. 18(9) to 18(11), in each of the scanning signals $Y_1$ to $Y_{768}$, timing of the image writing pulse $P_D$ is a little deviated and timing for the blanking pulse $P_B$ is a little deviated by a period of time being one-fourth of one frame between two pieces of image writing pulses $P_B$. As shown in FIGS. 19(1) to 19(8), each of the backlight control signals $S_{L1}$ to $S_{L8}$ is a little deviated and goes low only during one-half of one frame period.

Next, lighting rate, power consumption, and display luminance of the backlight 10 by the blanking code BC and blanking ratio are compared between the measure A and the measure B in the second conventional example.

FIG. 20 is a diagram showing a result from comparison of the backlight 10 between the measure A and the measure B according to the first embodiment. As is apparent from FIG. 20, in the case of the measure A, since the eight pieces of the fluorescent lamps $\mathbf{12}_1$ to $\mathbf{12}_8$ are simultaneously flashed, a peak of the lighting rate remains unchanged. In contrast, in the case of the measure B, since the eight pieces of the fluorescent lamps $\mathbf{12}_1$ to $\mathbf{12}_8$ are sequentially flashed, a peak of the lighting rate changes depending on the blanking ratio. Moreover, both in the case of the measure A and the measure B, an average of the lighting rate changes depending on the blanking ratio.

In FIG. 21, a comparison of power consumption in the backlight 10 occurring when illumination of the fluorescent lamp is controlled so that the display luminance in the measure A and measure B and in the conventional example is equal to each other is provided. In FIG. 21, if the blanking ratio is 0%, power consumption is equal in each of cases and it is 100%. In the above second conventional example, if the blanking ratio is "a" %, the power consumption is {100/(100−a)} % (a>0). As is apparent from FIG. 21, though no difference occurs in the power consumption at a peak time among the case of the second conventional example, the measures A and the measure B, a remarkable difference occurs in the average power consumption among the case of the second conventional example, the measures A and the measure B. This is due to following reasons. That is, when the blanking ratio is made higher, in order to maintain the same display luminance as is a case in which the blanking ratio is 0%, if no measure is taken, power consumption by the backlight 10 increases. As in the case of the measure A, by applying the blanking pulses $P_B$ to all scanning electrodes and by turning off the backlight 10, though the power consumption at the peak time remains unchanged and when the lighting of the backlight 10 is made useless, if the backlight 10 is turned ON, average power consumption can be decreased. On the other hand, in the case of the measure B, since the eight pieces of the fluorescent lamps $\mathbf{12}_1$ to $\mathbf{12}_8$ are sequentially flashed depending on the blanking ratio, it is possible to reduce both power consumption at the peak time and average power consumption of the backlight 10. Moreover, in FIG. 21, values in brackets represent the display luminance obtained when the luminance of the backlight 10 is not changed and when the power consumption at the peak time is maintained at 100% at all the time.

Figure 23:
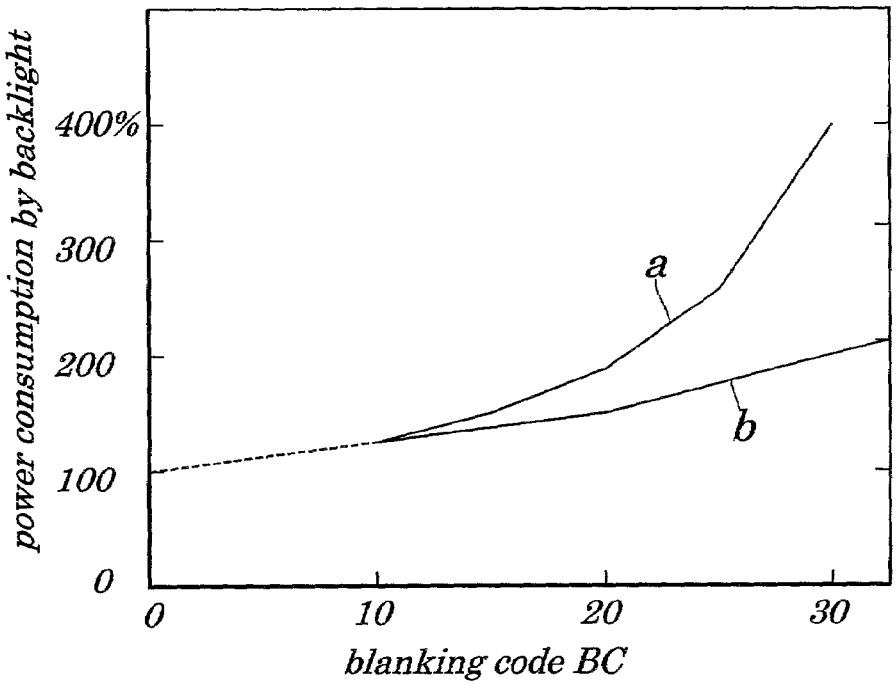
FIG. 23 is a diagram showing power consumption required for maintaining display luminance obtained when the display luminance is 100% obtained when the blanking code BC is "0" according to the first embodiment of the present invention.

FIG. 22 shows a result from comparison of a rate of power consumption and display luminance among the case of the second conventional example, the measure A and the measure B obtained when the consumption power and display luminance are 100% occurring when the blanking ratio is 0% and when it is impossible to raise luminance of the backlight 10 from 100% that can be obtained when the blanking ratio is 0% only up to 133% at the maximum, that is, when the power consumption at the peak time cannot be raised only up to 133% among the case of the second conventional example, the measure A and the measure B. Moreover, FIG. 23 shows diagram illustrating power consumption required for maintaining display luminance obtained when the display luminance is 100% obtained when the blanking code BC is "0" according to the first embodiment of the present invention. That is, FIG. 23 shows a graph that plots the power consumption shown in FIG. 21. In FIG. 23, a curve "a" shows a state obtained when the power consumption is at its peak level in the cases of the second conventional example and of the measure A, while a curve "b" shows a state when the power consumption is at its average level in the case of the measure A and is at its peak level and at its average level in the case of the measure B.

Figure 24:
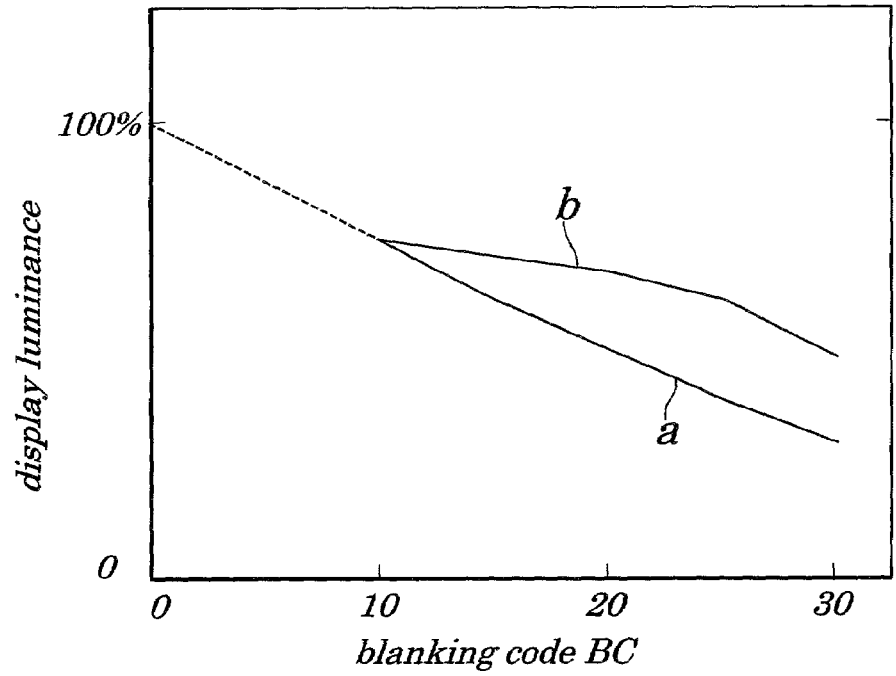
FIG. 24 is a diagram illustrating display luminance that can be maintained by power consumption being 100% if a blanking code BC is "0" according to the first embodiment of the present invention.
Figure 25:
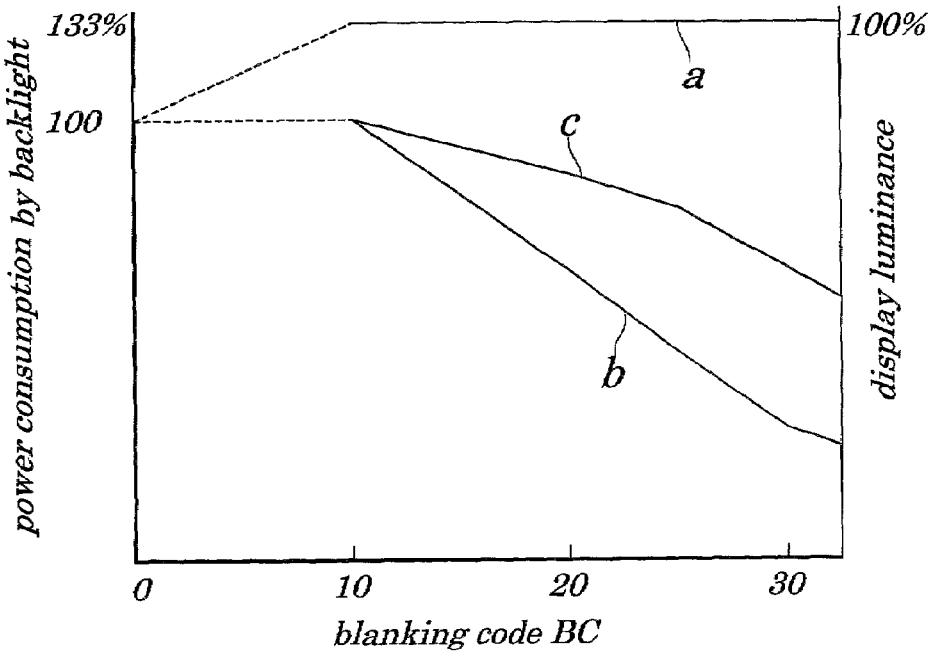
FIG. 25 is a diagram showing display luminance and power consumption required for maintaining display luminance obtained when the power consumption and display luminance are 100% obtained when the blanking code BC is "0" according to the first embodiment of the present invention.

FIG. 24 is a diagram illustrating display luminance that can be maintained by power consumption being 100% if a blanking code BC is "0" according to the first embodiment of the present invention. That is, FIG. 24 shows values obtained by plotting display luminance shown in FIG. 21. In FIG. 24, a curve "a" shows a state obtained when the power consumption is at its peak level in the cases of the second conventional example and of the measure A, while a curve "b" shows a state obtained when the display luminance is at its average level in the case of the measure A and is at its peak and at its average level in the case of the measure A. FIG. 25 is a diagram showing display luminance and power consumption required for maintaining display luminance obtained when the power consumption and display luminance are 100% occurring when the blanking code BC is "0" and when it is possible to raise luminance of the backlight 10 from 100% that can be obtained when the blanking ratio is 0% only up to 133% at the maximum, that is, when the power consumption at the peak time can be raised only up to 133%. That is, FIG. 25 shows values obtained by plotting the display luminance shown in FIG. 22. In FIG. 25, a curve "a" shows a state obtained when the power consumption is at its peak level and at its average level in the cases of the second conventional example and of the measure A and in the cases of the second conventional example and of the measure B, while a curve "b" shows a state obtained when the display luminance is at its peak level in the cases of the second conventional example and of the measure A, and further a curve "c" shows a state obtained when the display luminance is at its mean level in the case of the measure A and is at its peak level and at its average level in the case of the measure B.

Thus, according to the first embodiment, based on motion vector data $D_V$ extracted from a plurality of motion vectors to be detected from an image, the blanking timing producing circuit 5, gamma correcting circuit 6, and inverter 11 are controlled. Therefore, according to the configurations of the embodiment, no flicker occurs, and neither tail-leaving phenomenon nor image retention occurs, and even if the blanking is provided, power consumption in the backlight 10 can be reduced. This enables a power circuit adapted to supply power to be so configured to be small-sized and at low prices.

Next, a specified example of power consumption in the backlight 10 is explained. When the color LCD 1 is of an above WXGA type and display luminance is set to be usually 500 [cd/m$^2$] at a time of driving and when display pattern called a "checker flag" is displayed on the color LCD 1 at maximum display luminance, power consumption in the backlight 10 is about 12 W. Here, a checker flag represents a display pattern in which a square in white color and a square in black color both having a same shape are alternately arranged. The power consumption of about 12 W, as shown in FIG. 12, in the case of the average value achieved by the measure A and in the case of the peak value and average value achieved by the measure B, is reduced to about one half.

Second Embodiment

Figure 26:
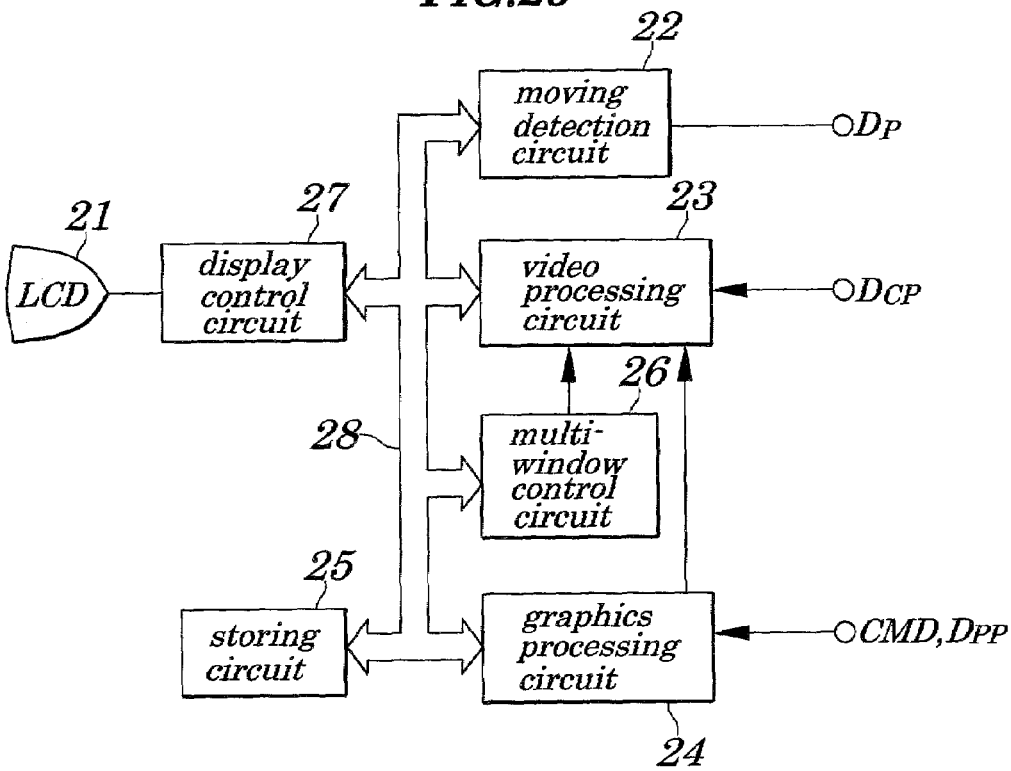
FIG. 26 is a block diagram showing configurations of an LCD employing a method of displaying an image on an LCD according to a second embodiment of the present invention.

FIG. 26 is a block diagram showing configurations of an liquid crystal display device employing a method of displaying an image on an LCD according to a second embodiment of the present invention.

The liquid crystal display device includes an LCD 21, a moving detecting circuit 22, a video processing circuit 23, a graphics processing circuit 24, a storing circuit 25, a multi-window control circuit 26, a display control circuit 27, and a bus 28. The moving detecting circuit 22, the video processing circuit 23, the graphics processing circuit 24, the storing circuit 25, the multi-window control circuit 26, the display control circuit 27 are connected, through the bus 28, to each other. Moreover, a backlight (not shown) is turned ON at all the time.

Figure 27:
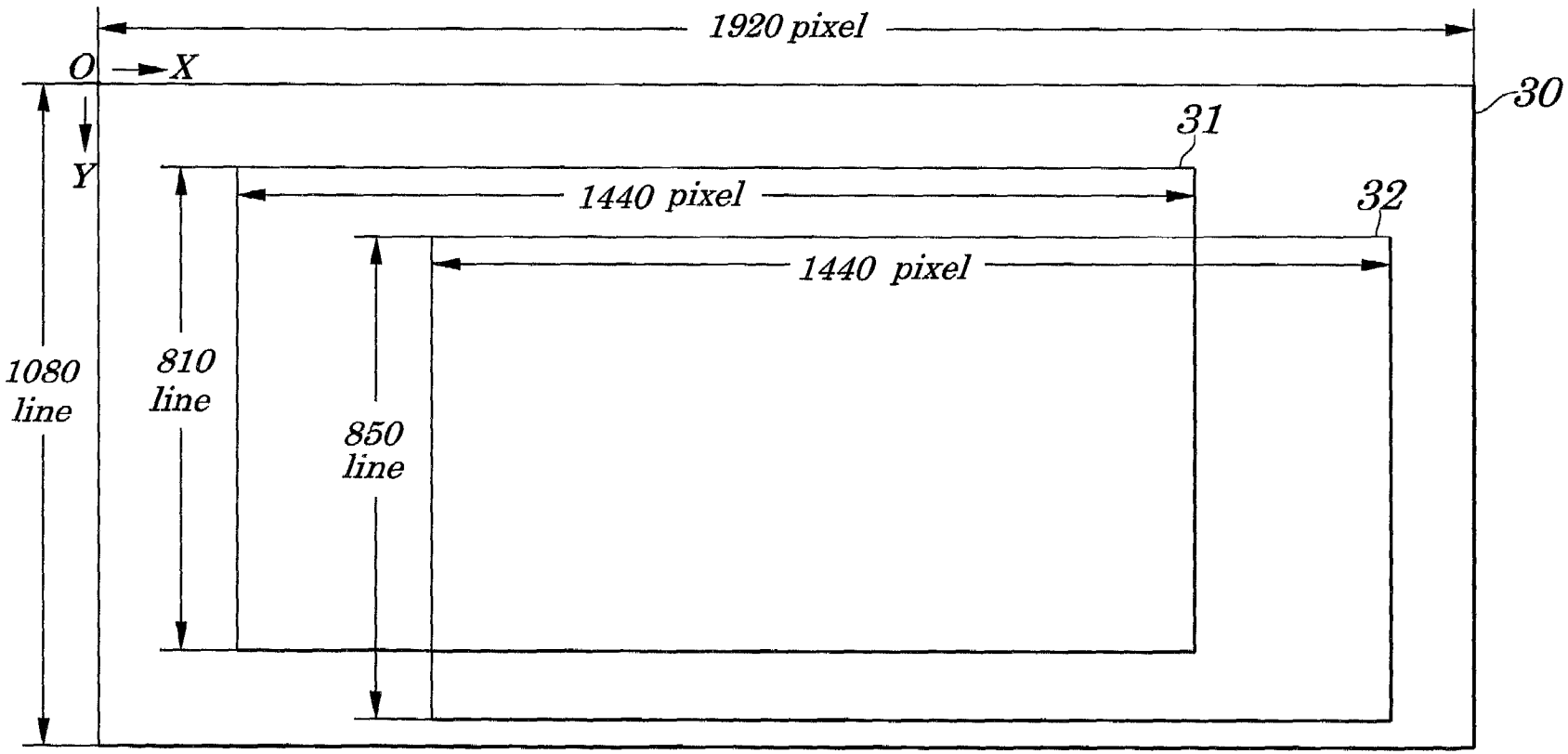
FIG. 27 is a diagram showing one example of a screen in which three windows are displayed according to the second embodiment of the present invention.

The LCD 21, as shown in FIG. 27, has a resolution of 1080 lines×1920 pixels on which a window 31 having a resolution of 810 lines×1440 pixels and a window 32 having a resolution 850 lines×1400 pixels are displayed. Hereinafter, an entire display screen of the LCD 21 is called a "window 30".

The moving detecting circuit 22 detects a plurality of motion vectors for every screen making up digital video data $D_P$ which is fed from an outside and has not been compressed and extracts a fastest motion vector out of the plurality of motion vectors. Moreover, the moving detecting circuit 22, based on extracted fastest motion vectors, sets a moving picture parameter $MP_1$ and transfers it to the display control circuit 27 through the bus 28. In the embodiment, the moving picture parameter $MP_1$ is set so as to correspond to a blanking rate of 0 to 75%. In the case of a still image, the blanking rate is 0%. Moreover, refer for configurations and operations of the method for detecting a motion vector and a detecting circuit to Japanese Patent Application Laid-open Nos. Hei 9-93585 and Hei 9-212650. Moreover, the moving detecting circuit 22 transfers digital video data $D_P$ through the bus 28 to the storing circuit 25.

The video processing circuit 23 detects a plurality of motion vectors for every screen making up the digital video data $D_{CP}$ which is fed from an outside and has been compressed and extracts a fastest motion vector. Moreover, the video processing circuit 23, based on the extracted fastest motion vector, sets a moving picture parameter $MP_2$ and transfers a display control circuit 27 through the bus 28 to the display control circuit 27. In the embodiment, the moving picture parameter $MP_2$ is set so as to correspond to the blanking rate of 0 to 75%. In the case of a still image, the blanking ratio is 0%. Moreover, the video processing circuit 23 expands digital video data $D_{CP}$ to digital video data $D_{EP}$ and transfers the digital video data $D_{EP}$ obtained by the expansion to the storing circuit 25 through the bus 28. The video processing circuit 23, when expanding digital video data $D_{CP}$ to the digital video data $D_{EP}$, performs processing of reducing resolution depending on a congestion state at a time of transferring data in the bus 28 and on a storage capacity of the storing circuit 25. Here, "processing of reducing resolution" represents processing of reducing an amount of data of the digital video data $D_{EP}$.

The graphics processing circuit 24, based on an image writing instruction CMD fed from an outside and on the image writing data $D_{PP}$, produces still picture data $D_{SP}$ and transfers the still picture data $D_{SP}$ through the bus 28 to the storing circuit 25. The storing circuit 25 is made up of image memories such as a RAM (Random Access Memory) or a like and stores digital video data $D_P$, digital video data $D_{EP}$, and still picture data $D_{SP}$ being transferred through the bus 28 to a specified area.

The multi-window control circuit 26 manages display, information, and the above moving picture parameters for all windows to be displayed on the LCD 21 shown in FIG. 27. Moreover, the multi-window control circuit 26 feeds maximum access speed "α" and storage capacity X of the storing circuit 25, and information about windows 30 to 32, for example, "kind of a display content T" or "priority P". The "kind of the display content T" is fed to identify its kind of contents to be displayed in the windows 30 to 32, mainly in the form of data. The "kind of the display content T" is "1" for the graphics data and "2" for the video data. Moreover, the "priority P" is provided to indicate a "forward-backward" relation when a plurality of windows is displayed on the LCD 21. If a value of the priority P is, for example, "1", it indicates that the window is located at a most foremost position. Then, as a value of the priority P increases, for example, from "2" to "3", it indicates that the window is located sequentially behind. FIG. 28 is a diagram illustrating one example of information about each of windows 30 to 32 and a moving picture parameter managed by a multi-window control circuit according to the second embodiment of the present invention. As shown in FIG. 28 and FIG. 29, a window size, a window position, a kind of a display content, a priority P, and a moving picture parameter are managed by a window number. A content shown in FIG. 29 is described later.

The display control circuit 27 performs display of each window, based on an instruction issued from the multi-window control circuit 26. That is, first, the display control circuit 27 reads the digital video data $D_P$, digital video data $D_{EP}$, and still picture data $D_{SP}$ to be displayed on each window from the storing circuit 25. Next, the display control circuit 27 performs processing of reduction (that is, "thinning-out" processing) or of expansion (that is, interpolation processing) of the read digital video data $D_P$, digital video data $D_{EP}$, and still picture data $D_{SP}$ in a manner so as to match a size of a window used to display each of the above digital data $D_P$, digital video data $D_{EP}$, and still picture data $D_{SP}$ and displays on the LCD 21. For example, if the digital video data $D_{EP}$ is stored in a state in which it is "thinned-out" (that is, reduced) to be one half in a longitudinal direction in the storing circuit 25, the display control circuit 27, after having interpolated data which has been "thinned-out" in a longitudinal direction from the digital video data $D_{EP}$, displays it on a corresponding window. At this point, the moving detecting circuit 22 performs processing of reduction and expansion, based on moving picture parameters $MP_1$ and $MP_2$ fed from the moving detecting circuit 22 and the video processing circuit 23, and creates a display moving picture parameter PM so as to cause a smooth change in each of the windows. The setting is made so that tracing (that is, a change in a display moving picture parameter) is made faster when a motion of an object in an image becomes faster and so that the tracing is made slower when a motion of an object in an image becomes slower (that is, by hysteresis control). A reason why the hysteresis control is employed here is as follows. In general, a human does not react to a change when a still picture is switched to a moving picture, however, a human reacts to a change when a moving picture is switched to a still picture.

Figure 30:
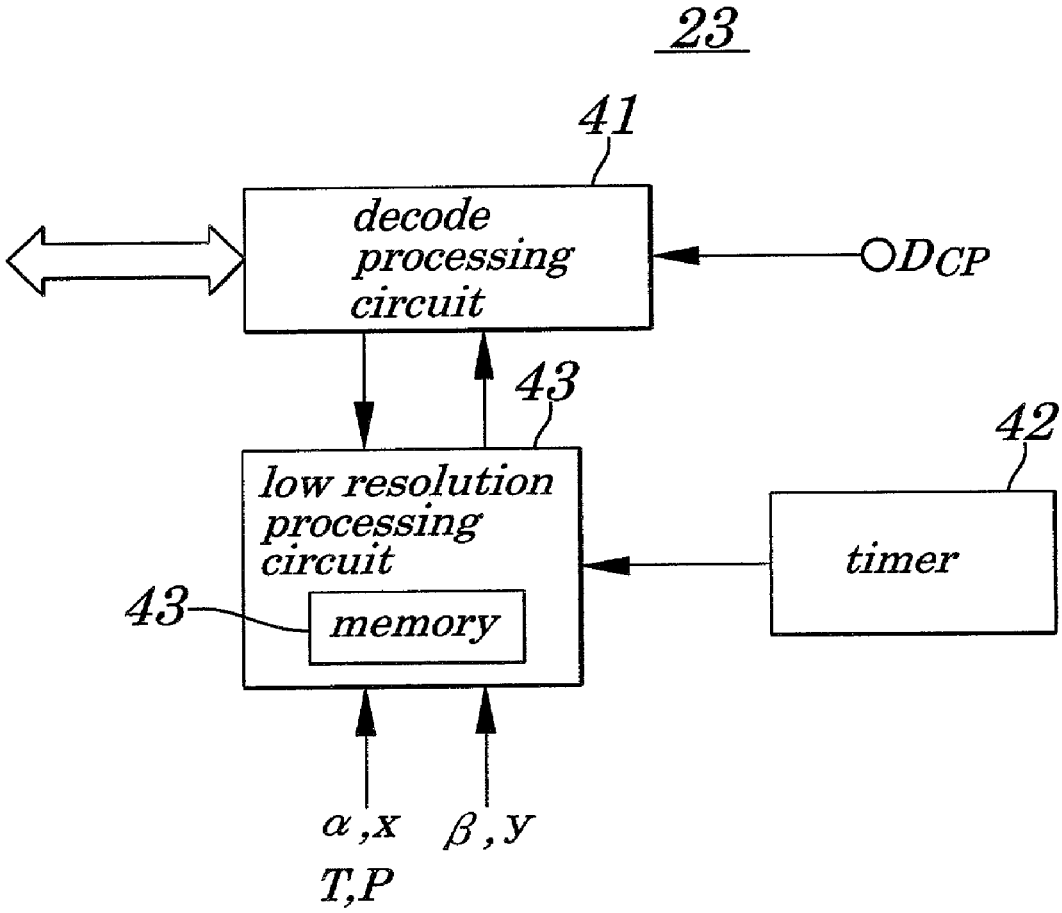
FIG. 30 is a block diagram illustrating a configuration of a video processing circuit according to the second embodiment of the present invention.

Next, configurations of the video processing circuit 23 are described. FIG. 30 is a block diagram illustrating a configuration of the video processing circuit 23 according to the second embodiment of the present invention. The video processing circuit 23 of the embodiment includes a decode processing circuit 41, a timer 42, and a low resolution processing circuit 43.

The decode processing circuit 41 detects a plurality of motion vectors from every screen making up the digital video data $D_{CP}$ being fed from an outside and being compressed and extracts the fastest vector from the plurality of motion vectors. Moreover, the decode processing circuit 41, based on the extracted fastest motion vector, sets a moving picture parameter $MP_2$ and transfers it through the bus 28 to the display control circuit 27.

Moreover, the decode processing circuit 41 expands the fed digital video data $D_{CP}$ to the digital video data $D_{EP}$ and transfers the digital video data $D_{EP}$ obtained from the expansion through the bus 28 to the storing circuit 25. The decode processing circuit 41, when expanding the digital video data $D_{CP}$ to the digital video data $D_{EP}$, performs "thinning-out" processing, based on an instruction from the low resolution processing circuit 43. The decode processing circuit 41 accepts an instruction from the low resolution processing circuit 43, for example, in a form of "k=½". This causes the decode processing circuit 41 to perform the "thinning-out" to reduce the data to one half when the expansion is performed. The above symbol "k" denotes a "thinning-out" coefficient which indicates a coefficient representing a rate of an amount of the digital video data obtained by the "thinning-out" processing to an amount of the digital video data $D_{CP}$ obtained by expanding the compressed digital video data $D_{CP}$ without performing the "thinning-out" processing. Therefore, the smaller the value of the thinning-out coefficient "k" is, the more the digital video data is thinned out. FIG. 29A and 29B show concrete examples of the "thinning-out" processing to be performed by the decode processing circuit 41. In FIG. 29A and 29B, a line number denotes a number of a row and a pixel number denotes a number of a column. FIG. 29A shows a case in which a pixel block having a resolution of 8 pixels×8 lines is thinned out to be a pixel block having a resolution of 4 pixels×8 lines. In this case, the decode processing circuit 41 performs the thinning-out on every one line using the thinning-out coefficient "k" (=½) fed from the low resolution processing circuit 43. On the other hand, FIG. 29B shows a case in which the pixel block having 8 pixels×8 lines is thinned out to be a pixel block having 4 pixels×4 lines. In this case, the decode processing circuit 41 performs the thinning-out on every one column and, at the same time, on every one line, using the thinning-out coefficient "k" (=¼) fed from the low resolution processing circuit 43.

The timer 42 has a function of measuring a time and, every time one second has elapsed, notifies a lapse of time of the low resolution processing circuit 43. The low resolution processing circuit 43 internally has a memory 44 to store information required for low resolution processing. The low resolution processing circuit 43 is supplied with necessary information from the multi-window control circuit 26, the graphics processing circuit 24, and the decode processing circuit 41 and judges whether or not the low resolution processing is required and, when the low resolution processing is judged to be required, issues an instruction for the "thinning-out processing" to be performed by the decode processing circuit 41. The low resolution processing circuit 43 judges whether or not the low resolution processing is required based on the priority P of each window, a kind of a content to be displayed in a window, or a like. The low resolution processing circuit 43, if the priority P of the window 31 is "2" and the window 31 is located at a rear of the window 32, judges that the low resolution processing is required.

Figure 31:
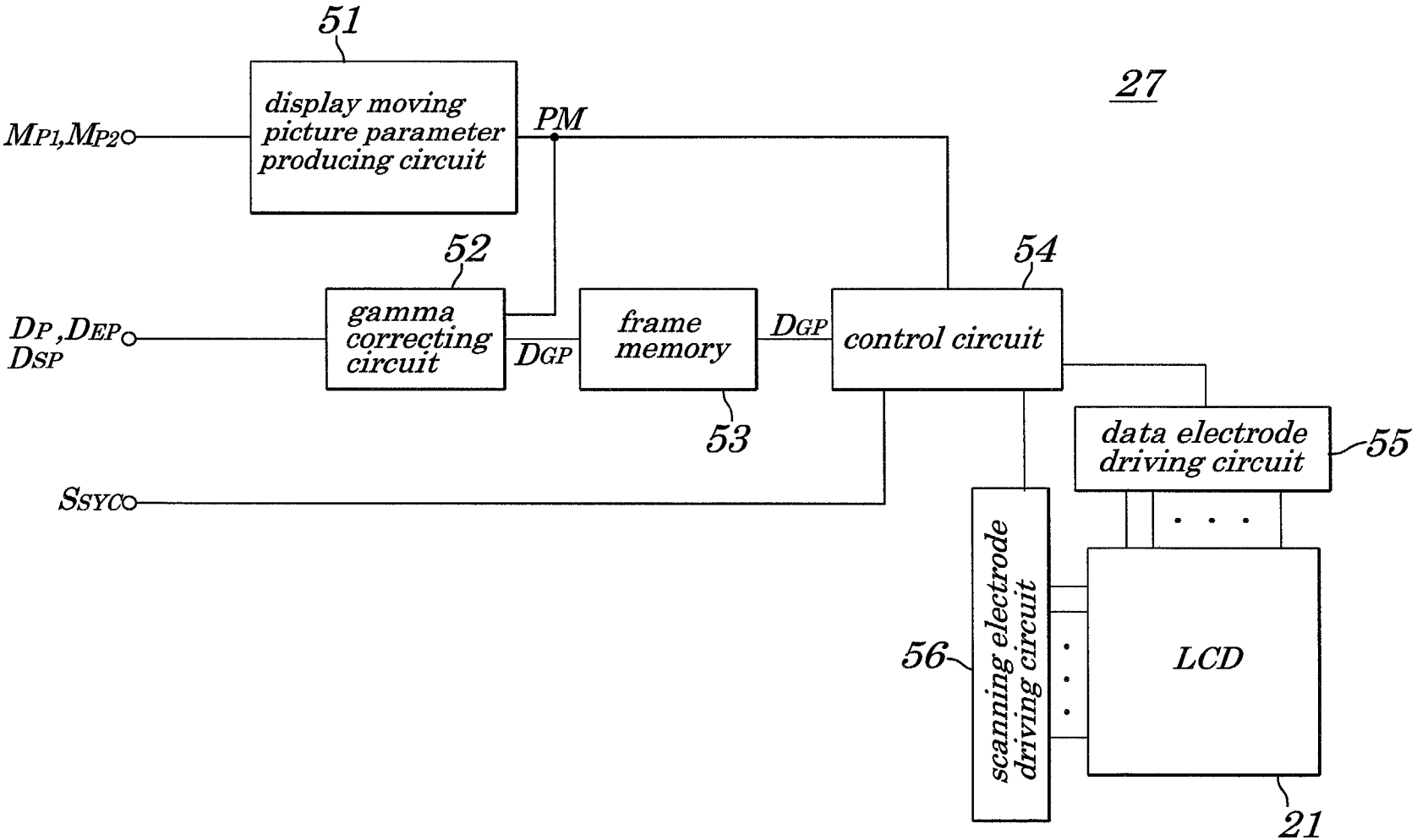
FIG. 31 is a block diagram showing configurations of a display control circuit according to the second embodiment of the present invention.

Next, configurations of the display control circuit 27 will be described in detail. FIG. 31 shows a block diagram showing configurations of the display control circuit 27 of the embodiment. The display control circuit 27 of the embodiment includes a display moving picture parameter producing circuit 51, a gamma correcting circuit 52, a frame memory 53, a control circuit 54, a data electrode driving circuit 55, and a scanning electrode driving circuit 56.

Figure 32:
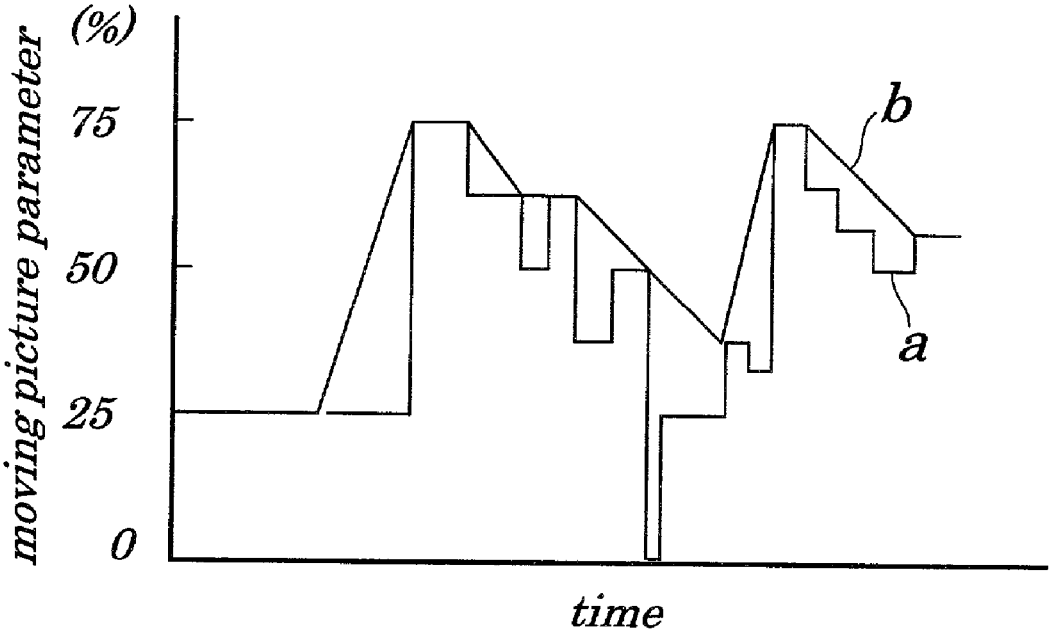
FIG. 32 is a diagram showing an example of a change of a display moving picture parameter to a change of a moving picture parameter according to the second embodiment of the present invention.

The display moving picture parameter producing circuit 51 produces a display moving picture parameter PM, based on moving picture parameters $MP_1$ and $MP_2$ fed from the moving detecting circuit 22 and the video processing circuit 23, so that a smooth change occurs in each window. Here, FIG. 32 shows an example of a relation between moving picture parameters $MP_1$ and $MP_2$ and the display moving picture parameter PM. In FIG. 32, a waveform "a" denotes moving picture parameters $MP_1$ and $MP_2$ and a waveform "b" denotes moving picture parameter PM. In an example shown in FIG. 32, a following speed of a display moving picture parameter PM to follow a rise of the moving picture parameters $MP_1$ to $MP_2$ is set to be larger by four times than a following speed of a display moving picture parameter PM to follow a fall of the moving picture parameters $MP_1$ and $MP_2$.

The gamma correcting circuit 52 provides gray scales by making a gamma correction to digital video data $D_P$, digital video data $D_{EP}$, and still picture data $D_{SP}$ being all digital video data read from the storing circuit 25, based on the display moving picture parameter MP fed from the display moving picture parameter producing circuit 51 and then outputs them as image data $D_{GP}$. The frame memory 53 is made up of a semiconductor memory such as a RAM, or a like and is controlled by the control circuit 54 and stores a plurality of frames of the image data $D_{GP}$ being fed from the gamma correcting circuit 52.

Figure 33:
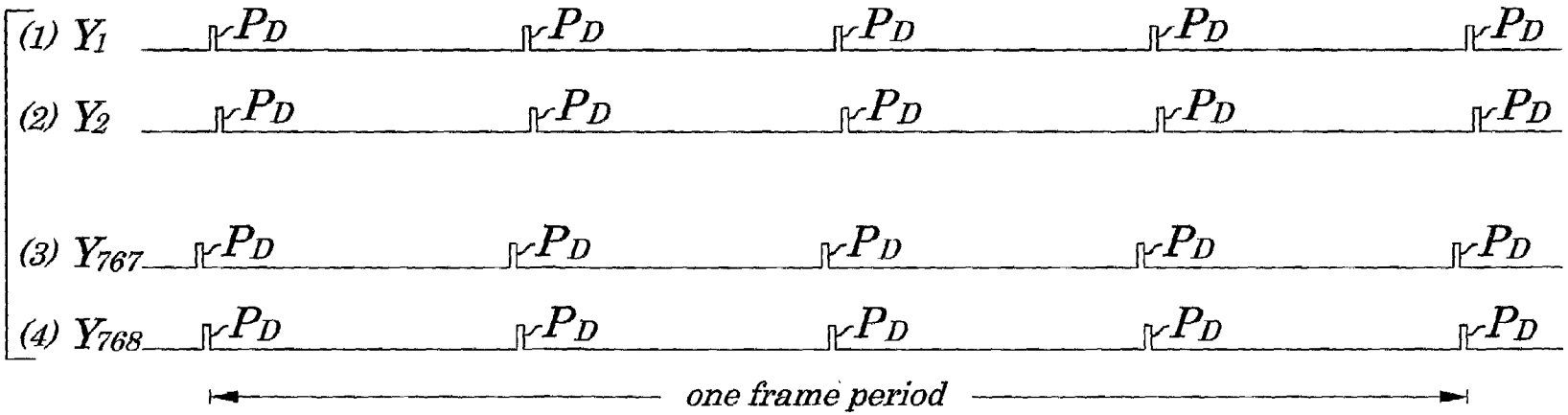
FIG. 33 is a timing-chart showing one example of operations of a control circuit employed in the second embodiment of the present invention.
Figure 34:
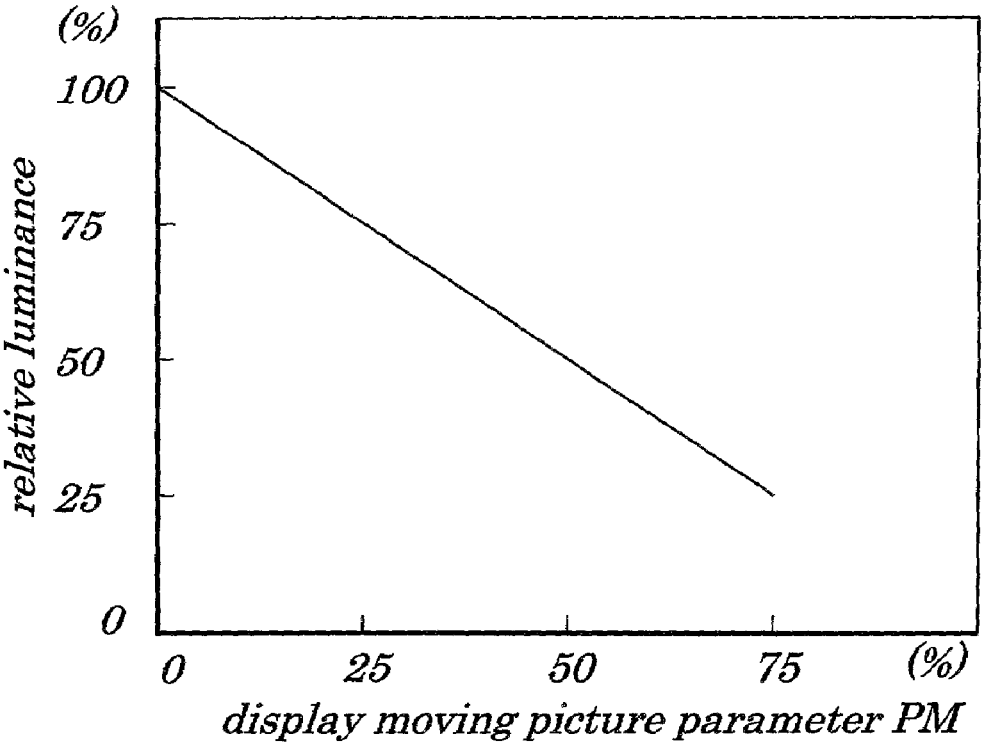
FIG. 34 is a diagram showing one example of a relation between a display moving picture parameter and relative luminance employed in the second embodiment of the present invention.

The control circuit 54 is made up of, an ASIC and controls storage of the image data $D_{GP}$ to the frame memory 53, based on a synchronous signal $S_{SYC}$ fed from an outside and transfers the image data $D_{GP}$ or a blanking signal read from the frame memory 53, based on a display moving picture parameter PM fed from the display moving picture parameter producing circuit 51 to the data electrode driving circuit 55. Moreover, the control circuit 54, based on a synchronous signal $S_{SYC}$ or a display moving picture parameter PM, controls the data electrode driving circuit 55 and the scanning electrode driving circuit 56. That is, as shown in FIG. 33, the control circuit 54 applies scanning signals $Y_1$ to $Y_{768}$ each being made up of four pieces of the image writing pulse $P_D$ to the scanning electrode so that a same data signal is applied four times to the data electrode during one frame period. This is because the blanking ratio is different in each pixel in one line. Therefore, simply speaking, only four kinds of the blanking ratios including 0%, 25%, 50%, and 75% can be set. However, in order to improve a quality of an image, as shown in FIG. 32, control is required so as to smoothly change a display moving picture parameter PM and, to correspond to the change, as shown in FIG. 34, it is necessary to smoothly change relative luminance. Then, the control circuit 54, as shown in FIG. 35, exerts control on an image display by changing each parameter. That is, as shown in FIG. 33, only if the scanning signals $Y_1$ to $Y_{768}$ each being made up of four pieces of the image writing pulse $P_D$ during one frame period are applied to the scanning electrode, only four kinds of the blanking ratios including 0%, 25%, 50%, and 75% can be set. Therefore, the relative luminance is indicated as a relative luminance obtained before multiplication as shown in FIG. 35 and only four kinds of the relative luminance including 100%, 75%, 50% and 25% can be obtained. Then, the control circuit 54, by multiplying the image data $D_{GP}$ by the multiplication coefficient shown in FIG. 35 and by adjusting luminance using only the image data $D_{GP}$, exerts control so that final relative luminance is changed in such a manner as shown in FIG. 34. Moreover, if the image data $D_{GP}$ is still image data $D_{SP}$, an image signal, instead of a blanking signal, is applied to the data electrode. The data electrode driving circuit 55, with timing in which various types of the control signals are fed from the control circuit 54, selects a specified gray scale voltage by the image data $D_{GP}$ or the blanking signal fed from the control circuit 54 and applies the selected gray scale voltage as a data signal to a corresponding data electrode in the LCD 21. The scanning electrode driving circuit 56, with timing in which a control signal is fed from the control circuit 54, sequentially produces a scanning signal and sequentially feeds the produced signal to a corresponding scanning electrode in the LCD 21.

Figure 37:
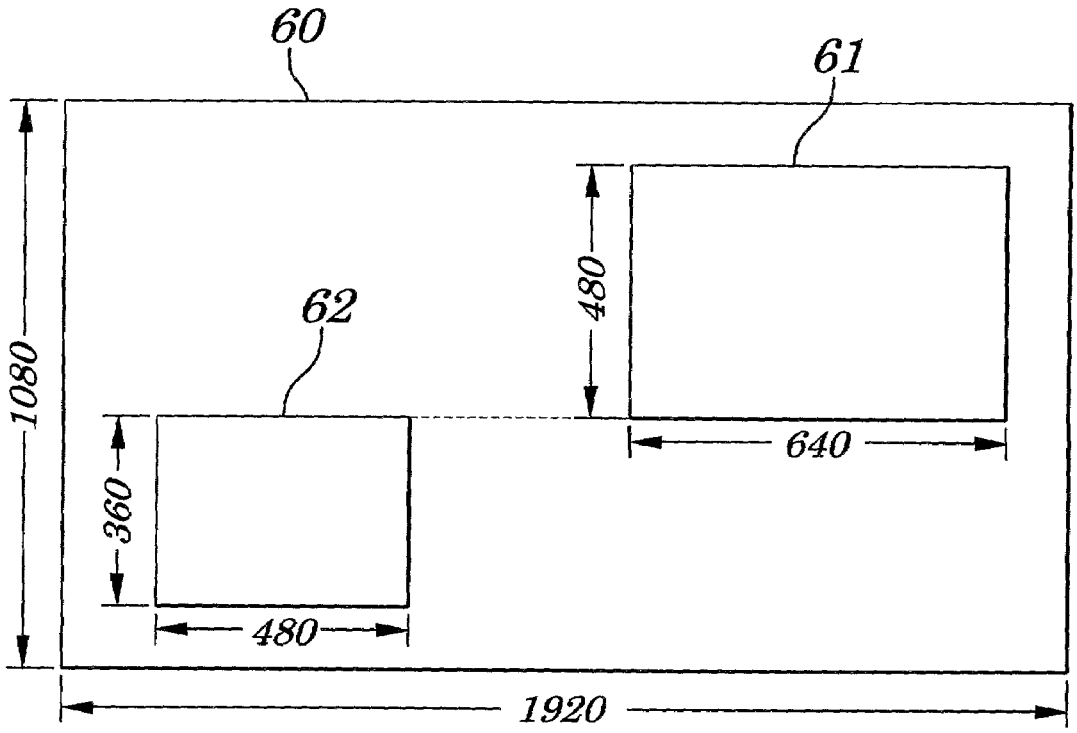
FIG. 37 is a diagram illustrating other examples of a screen to display three windows in the LCD according to the second embodiment of the present invention.

Thus, according to configurations of the second embodiment, when multi-windows are displayed in the LCD 21, if a kind of a display content of image data to be displayed in each window is different, it is possible to exert control on a display moving picture PM for every window. Therefore, in this case, an image of high quality is obtained. At this point, the blanking ratio can be set only in a discrete manner to include 0%, 25%, 50%, and 75%. However, the display moving picture parameter PM can be smoothly set. FIG. 37 shows an example of the LCD 21 having configurations being different from those of the LCD 21 as shown in FIG. 27. FIG. 37 shows a screen of the LCD 21 and, as in the case of the screen shown in FIG. 27, has a resolution of 1080 lines×1920 pixels. However, a window shown in FIG. 37 is different from that shown in FIG. 27 and includes a window 61 having a resolution of 480 lines×640 pixels, a window 62 having a resolution of 360 lines×480 pixels, and a window 60 being an entire display screen. Out of the three windows, there may exist a plurality of windows to display a moving picture and each of the plurality of windows to display a moving picture does not share a same scanning line. That is, for example, when a moving picture is displayed in the window 61 and the window 62, as shown in FIG. 37, each of the window 61 and window 62 does not share a same scanning line. In this case, a moving picture cannot be displayed on the window 60. Conversely, when a moving picture is displayed in the window 60, it is impossible to display a moving picture in the windows 61 and 62. Thus, by configuring the window as above and by controlling the moving picture display, the moving picture display method in which a measure A or a measure B is employed provided in the first embodiment can be used. This enables power consumption of a backlight to be reduced. Moreover, by continuously changing the blanking ratio, the image of high quality can be achieved.

Figure 36:
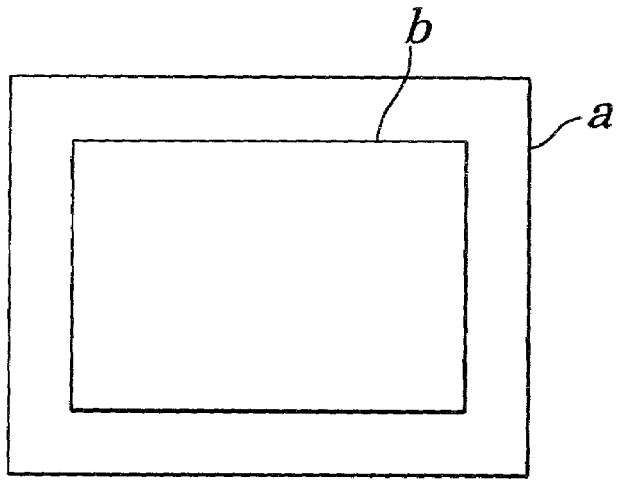
FIG. 36 is a diagram explaining a modified example of the first embodiment of the present invention.

It is apparent that the present invention is not limited to the above embodiments but may be changed and modified without departing from the scope and spirit of the invention. For example, in the above first embodiment, the example in which a motion vector is detected from an entire screen of an LCD 1 is shown, however, as shown in FIG. 36, a place of detection of a motion vector may be limited to a center portion "b" on an entire screen "a" of the LCD 1.

Moreover, in the above first embodiment, the example is shown in which a moving parameter is set based on a motion vector data $D_V$, however, a moving picture parameter may be set based on a size of the motion vector data $D_V$.

Also, in the above first embodiment, the example is shown in which both a blanking ratio and lighting rate of the backlight 10 are changed based on the motion vector data $D_V$, however, only either of them may be changed.

Also, in the above first embodiment, the example is shown in which the eight pieces of fluorescent lamps $\mathbf{12}_1$ to $\mathbf{12}_8$ are mounted, however, any number of the fluorescent lamps may employed. Moreover, a light source is not limited to the fluorescent lamp and various types of light source may be used.

Also, in each of the above embodiments, the example is shown in which a motion vector is detected from digital video data. However, for example, if digital data fed from an outside is compressed or encoded by MPEG (Moving Picture Expert Group) 1, MPEG 2, and MPEG 3, since a motion vector is already included, this motion vector may be employed. This enables omission of detection of the motion vector and also enables display of a moving picture on the LCD in real time.

Also, in each of the embodiments, no control is exerted on a portion in which switching is done between a moving picture and a still picture, however, control may be exerted so that a moving picture parameter is changed, with a specified slant, in a portion in which display luminance is changed. Moreover, control may be exerted so that a moving picture parameter is changed based on a size of motion vector data $D_V$. This can provide an image of high quality.

Also, in the above second embodiment and, in the example shown in FIG. 35, the display moving picture parameter PM is set by every 5%, however, it may be set in a more finer manner.

Also, in the above second embodiment, the example is shown in which the display moving picture parameter PM is changed at all the time, however, if a change is sharp in the moving picture parameters $MP_1$ and $MP_2$, there may be no change in the display moving picture parameter PM.

Also, in the second embodiment, no reference is made to a period during which the display moving picture parameter PM is changed, however, the display moving picture parameter PM may be changed at a midpoint of one line period.

Also, in the second embodiment, the example is shown in which two systems of the moving picture data including the digital video data $D_P$ and digital video data $D_{EP}$ and one system of the still picture data $D_{SP}$ are processed, however, if the moving picture data is made up of one system, the blanking ratio itself may be changed continuously. Both configurations and functions in the above embodiment can be employed each other as much as possible.

Also, in each of the embodiments, the example is shown in which the digital video data is processed, however, this invention may be applied to a case in which an analog video signal is processed.

Also, in each of the embodiments, the example is shown in which a motion vector is detected and in which a moving picture parameter is set based on the motion vector, however, a motion of an image based on correlation of a consecutive frame and based on that, the moving picture parameter may be set.

Also, in each of the embodiments, the example is shown in which the liquid crystal display device changes the blanking ratio automatically, an observer may change the blanking ratio according to his/her own preference and to a kind of the digital video data (for example, sports program).

Also, in each of the embodiments, the example is shown in which the blanking ratio is changed based on the moving picture parameter, however, the blanking ratio may change a level of the fixed blanking signal.

Furthermore, both the blanking ratio and a level of the blanking signal may be changed based on the moving picture parameters.

The present invention may be applied to a monitor of an information processing device such as a television set, a personal computer, or a like.

What is claimed is:

1. A method for displaying an image in the transmissive-type liquid crystal display device comprising a liquid crystal display and a backlight to emit light to said liquid crystal display from a rear of said liquid crystal display, said method comprising:

providing an image signal defining the image;

detecting motion in the image based on the image signal; and controlling each of a plurality of electrodes in the liquid crystal display by alternately providing each of the electrodes with the image signal and a non-image signal, wherein the alternation between the image and non-image signals is based on the detected motion;

wherein the image is made up of a plurality of windows defined by the image signal, and, based on the detecting step, the controlling step controls each of the electrodes so that those of said electrodes corresponding to one of the windows can be controlled differently from others of said electrodes corresponding to another of the windows; and wherein, based on said detecting step, when said image is determined to be a moving picture, said image signal and said non-image signal are fed during one frame period to said plurality of data electrodes and, when said image is determined to be a still image, said image signal only is fed during said one frame period two or more times to said plurality of data electrodes.

2. A transmissive-type liquid crystal display device comprising a liquid crystal display and a backlight to emit light to said liquid crystal display from a rear of said liquid crystal display, comprising:

a detection circuit constructed and arranged so as to detect a motion of an image represented by an image signal; and a control circuit constructed and arranged so as to control each of a plurality of electrodes in the liquid crystal display by alternately providing each of the electrodes with the image signal or a non-image signal, wherein the alternation between the image and non-image signals is based on the detected motion;

wherein the image is made up of a plurality of windows defined by the image signal, and said control circuit, based on said result of detection of a motion of said image, controls the electrodes so that those of said electrodes corresponding to one of the windows can be controlled differently from others of said electrodes corresponding to another of the windows; and wherein said control circuit, when the detection circuit determines said image to be a moving picture, feeds said image signal and said non-image signal during one frame period to said plurality of data electrodes and, when the detection circuit determines said image to be a still picture, feeds said image signal only during said one frame period two or more times to said plurality of data electrodes.

3. A method for displaying an image in the transmissive-type liquid crystal display device comprising a liquid crystal display and a backlight to emit light to said liquid crystal display from a rear of said liquid crystal display, said method comprising:

providing an image signal defining the image;

detecting motion in the image based on the image signal; and controlling each of a plurality of electrodes in the liquid crystal display by alternately providing each of the electrodes with the image signal and a non-image signal, wherein the alternation between the image and non-image signals is based on the detected motion;

wherein the image is made up of a plurality of windows and, based on the detecting step, the controlling step controls each of the electrodes so that those of said electrodes corresponding to one of the windows can be controlled differently from others of said electrodes corresponding to another of the windows; and wherein, based on said detecting step, when said image is determined to be a moving picture, said image signal and said non-image signal are fed during one frame period to said plurality of data electrodes and, when said image is determined to be a still image, said image signal only is fed during said one frame period two or more times to said plurality of data electrodes.

4. A transmissive-type liquid crystal display device comprising a liquid crystal display and a backlight to emit light to said liquid crystal display from a rear of said liquid crystal display, comprising:

a detection circuit constructed and arranged so as to detect a motion of an image represented by an image signal; and a control circuit constructed and arranged so as to control each of a plurality of electrodes in the liquid crystal display by alternately providing each of the electrodes with the image signal or a non-image signal, wherein the alternation between the image and non-image signals is based on the detected motion;

wherein the image is made up of a plurality of windows and said control circuit, based on said result of detection of a motion of said image, controls the electrodes so that those of said electrodes corresponding to one of the windows can be controlled differently from others of said electrodes corresponding to another of the windows; and wherein said control circuit, when the detection circuit determines said image to be a moving picture, feeds said image signal and said non-image signal during one frame period to said plurality of data electrodes and, when the detection circuit determines said image to be a still picture, feeds said image signal only during said one frame period two or more times to said plurality of data electrodes.

* * * * *